US010959899B2

(12) United States Patent
Sullivan et al.

(10) Patent No.: US 10,959,899 B2
(45) Date of Patent: Mar. 30, 2021

(54) DEVICE FOR ADJUSTABLY SUPPORTING PORTIONS OF A PATIENT FOR SURGERY

(71) Applicant: Warsaw Orthopedic, Inc., Warsaw, IN (US)

(72) Inventors: Charles S. Sullivan, Germantown, TN (US); Joshua A. Ruth, Edna, MN (US); Eric C. Lange, Collierville, TN (US); Richard A. Hynes, Melbourne Beach, FL (US)

(73) Assignee: WARSAW ORTHOPEDIC, INC., Warsaw, IN (US)

( * ) Notice: Subject to any disclaimer, the term of this patent is extended or adjusted under 35 U.S.C. 154(b) by 372 days.

(21) Appl. No.: 16/146,821

(22) Filed: Sep. 28, 2018

(65) Prior Publication Data

US 2020/0100973 A1 Apr. 2, 2020

(51) Int. Cl.

| | |
|---|---|
| ***A61G 13/12*** | (2006.01) |
| ***A61G 13/02*** | (2006.01) |
| ***A61G 13/00*** | (2006.01) |

(52) U.S. Cl.

CPC ..... *A61G 13/121* (2013.01); *A61G 13/02* (2013.01); *A61G 13/128* (2013.01); *A61G 13/0036* (2013.01); *A61G 13/1225* (2013.01); *A61G 13/1235* (2013.01); *A61G 2200/327* (2013.01)

(58) Field of Classification Search

CPC ..... A61F 5/3707; A61F 5/3769; A61G 7/072; A61G 7/07; A61G 13/121; A61G 13/02; A61G 13/128; A61G 13/0036; A61G 13/1225; A61G 13/1235; A61G 2200/327; A61B 6/0421; A47C 20/027

See application file for complete search history.

(56) References Cited

U.S. PATENT DOCUMENTS

| | | | | |
|---|---|---|---|---|
| 7,706,858 | B1 * | 4/2010 | Green | A61B 5/0555 600/415 |
| 2019/0151180 | A1 * | 5/2019 | Kantor | A61F 5/56 |

* cited by examiner

*Primary Examiner* — David R Hare
*Assistant Examiner* — Adam C Ortiz

(57) ABSTRACT

A patient support structure for supporting a patient in a supine position for surgery and a method for use of the patient support structure is provided. The patient support structure includes a back support portion, a neck support portion, and a head support portion. The back support portion includes a panel portion and padding padding movably attached to relative to the upper surface. The neck support portion includes an adjustable neck support pad and at least a first rotational adjustment assembly, where the first rotational adjustment assembly is configured to eccentrically rotate the neck support pad about an axis offset from a central axis of the rotatable neck pad. The head support portion includes at least one base portion, a first arm portion, a second arm portion, and a head harness, where the first arm portion and the second arm portion are adjustable inwardly/outwardly and upwardly/downwardly, and the head harness is supported by the first arm portion and the second arm portion.

20 Claims, 15 Drawing Sheets

DEVICE FOR ADJUSTABLY SUPPORTING PORTIONS OF A PATIENT FOR SURGERY

FIELD

The present technology is generally related to a device including a back support portion, a neck support portion, and a head support portion for adjustably supporting portions of a patient before, during, and after surgery.

BACKGROUND

Operating room tables are used to support a patient thereon during surgery. Typically, conventional operating room tables oftentimes have some form of coarse adjustment for generally adjusting portions of a patient's body. To illustrate, conventional operating room tables often have a first end portion, a second end portion, and a body portion positioned between the first end portion and the second end portion, where the first end portion and the second end portion are each pivotable with respect to the body portion. When a patient is positioned on such conventional operating room tables, the patient's buttocks and lower back, the first end portion can be pivoted to adjust the position of the upper portion of the patient's body, and the second end portion can be pivoted to adjust the position of the lower portion of the patient's body. However, such coarse adjustment of the patient's body does not provide fine adjustment of the patient's torso, neck, and head that may be necessary for some surgeries. Oftentimes, separate padding is inserted between the patient's body parts and the surfaces of such conventional operating room tables to position the patient's torso, neck, and head for surgery. However, such separate padding is oftentimes unwieldly and can be a challenge to adjust for surgery. Therefore, there is a need for a device that can be attachable to or integrated into an operating room table for adjustably supporting portions of a patient's buttocks, back, neck, and head thereon to finely position these body parts before, during, and after surgery.

SUMMARY

The techniques of this disclosure generally relate to a device including a back support portion, a neck support portion, and a head support portion for adjustably supporting portions of a patient before, during, and after surgery.

In one aspect, the present disclosure provides a method for adjustably supporting a patient in a supine position for surgery, the method including providing a patient support structure having a back support portion, a neck support portion, and a head support portion, the neck support portion and the head support portion each being attached to the back support portion, the back support portion including a panel portion having a first end, an opposite second end, and an upper surface extending between the first end and the second end, and the back support portion including padding movably attached to relative to the upper surface, the neck support portion including at least one upwardly-extending support arm, a rotatable neck pad, and at least one rotational adjustment assembly, the at least one upwardly-extending support arm being attached to the back support portion, the at least one upwardly-extending support arm supporting at least portions of the rotatable neck pad and the at least one rotational adjustment assembly thereon, the rotatable neck pad including a central axis, the at least one rotational adjustment assembly being interconnected with the neck pad, and the at least one rotational adjustment assembly being configured to eccentrically rotate the neck support pad about an axis offset from the central axis of the rotatable neck pad; the head support portion including at least one base portion, an upwardly-extending first arm portion, an upwardly-extending second arm portion, a first attachment assembly, a second attachment assembly, and a head harness, the upwardly-extending first arm portion and the upwardly-extending second arm portion being movably attached to the at least one base portion, each of the upwardly-extending first arm portion and the upwardly-extending second arm portion being movable between an inward first position and an outward second position relative to the at least one base portion, a first end portion of the upwardly-extending first arm portion supporting the first attachment assembly, and a second end portion of the upwardly-extending second arm portion supporting the second attachment assembly, the head harness being rotatably supportable by the first attachment assembly and the second attachment assembly between the upwardly-extending first arm portion and the upwardly-extending second arm portion, contacting at least a portion of the back of the patient to the padding of the back support portion; contacting at least a portion of the neck of the patient to the rotatable neck pad of the neck support portion; holding a portion of the head of the patient in the head harness of the head support portion, and supporting the head harness and the head of the patient between the upwardly-extending first arm portion and the upwardly-extending second arm portion; adjusting the padding of the back support portion to facilitate positioning of the back of the patient; eccentrically rotating the neck support pad using the at least one rotational adjustment assembly to facilitate positioning of the neck of the patient; and rotating the harness portion using the first attachment assembly and the second attachment assembly to facilitate positioning the head of the patient.

In another aspect, the disclosure provides a method for adjustably supporting a patient in a supine position for surgery, the method including providing a patient support structure having a back support portion, a neck support portion, and a head support portion, the neck support portion and the head support portion each being attached to the back support portion, contacting at least a portion of the back of the patient to padding of the back support portion, the back support portion including the padding, a first end, an opposite second end, and an upper surface for supporting the padding; contacting at least a portion of the neck of the patient to a neck pad of the neck support portion, the neck support portion including the neck pad, and at least one upwardly-extending support arm, the at least one upwardly-extending support arm supporting at least portions of the neck pad, and the at least one upwardly-extending support arm being movably attached to a portion of the back support portion, the at least one upwardly-extending support arm being capable of movement between a first position and a second position in the direction of the first end and the second end of the back support portion; holding a portion of the head of the patient in a head harness of the head support portion, and supporting the head harness and the head of the patient between an upwardly-extending first arm portion and an upwardly-extending second arm portion of the head support portion, the head support portion including the head harness, the upwardly-extending first arm portion, the upwardly-extending second arm portion, at least one base portion, a first attachment assembly, and a second attachment assembly, the upwardly-extending first arm portion including a first end portion supporting the first attachment assembly, and the upwardly-extending second arm portion including a second end portion supporting the second attachment assembly; adjusting the padding of the back support portion to facilitate positioning of the back of the patient; adjusting the position of neck support pad to facilitate positioning of the neck of the patient; and rotating the harness portion using the first attachment assembly and the second attachment assembly to facilitate positioning the head of the patient.

In yet another aspect, the disclosure provides a patient support structure for supporting a patient in a supine position for surgery, the patient support structure including a back support portion including a panel portion having a first end, an opposite second end, and an upper surface extending between the first end and the second end, and the back support portion including padding movably attached to relative to the upper surface; a neck support portion including an upwardly-extending first support arm, an upwardly-extending second support arm, a neck support pad, a first rotational adjustment assembly, and a second rotational adjustment assembly, the upwardly-extending first support arm and the upwardly-extending second support arm being movably attached to the back support portion, the upwardly-extending first support arm and the upwardly-extending second support arm each supporting at least portions of the rotatable neck pad, an end portion of the first support arm portion supporting the first rotational adjustment assembly and a first end of the neck support pad, an end portion of the second support arm portion supporting the second rotational adjustment assembly and a second end of the neck support pad, the first end of the neck support pad being interconnected with the first rotational adjustment assembly, and the second end of the neck support pad being interconnected with the second rotational adjustment assembly, the rotatable neck pad including a central axis, the first rotational adjustment assembly and the second rotational adjustment assembly being configured to eccentrically rotate the neck support pad about an axis offset from the central axis of the rotatable neck pad; and a head support portion including at least one base portion, an upwardly-extending first arm portion, an upwardly-extending second arm portion, a first attachment assembly, a second attachment assembly, and a head harness, the upwardly-extending first arm portion and the upwardly-extending second arm portion being movably attached to the at least one base portion, each of the upwardly-extending first arm portion and the upwardly-extending second arm portion being movable between an inward first position and an outward second position relative to the at least one base portion, a first end portion of the upwardly-extending first arm portion supporting the first attachment assembly, and a second end portion of the upwardly-extending second arm portion supporting the second attachment assembly, the head harness being rotatably supported by the first attachment assembly and the second attachment assembly between the upwardly-extending first arm portion and the upwardly-extending second arm portion.

The details of one or more aspects of the disclosure as set forth in the accompanying drawings and the description below. Other features, objects, and advantages of the techniques described in this disclosure will be apparent from the description and drawings, and from the claims.

DETAILED DESCRIPTION OF THE PREFERRED EMBODIMENT

Figure 1:
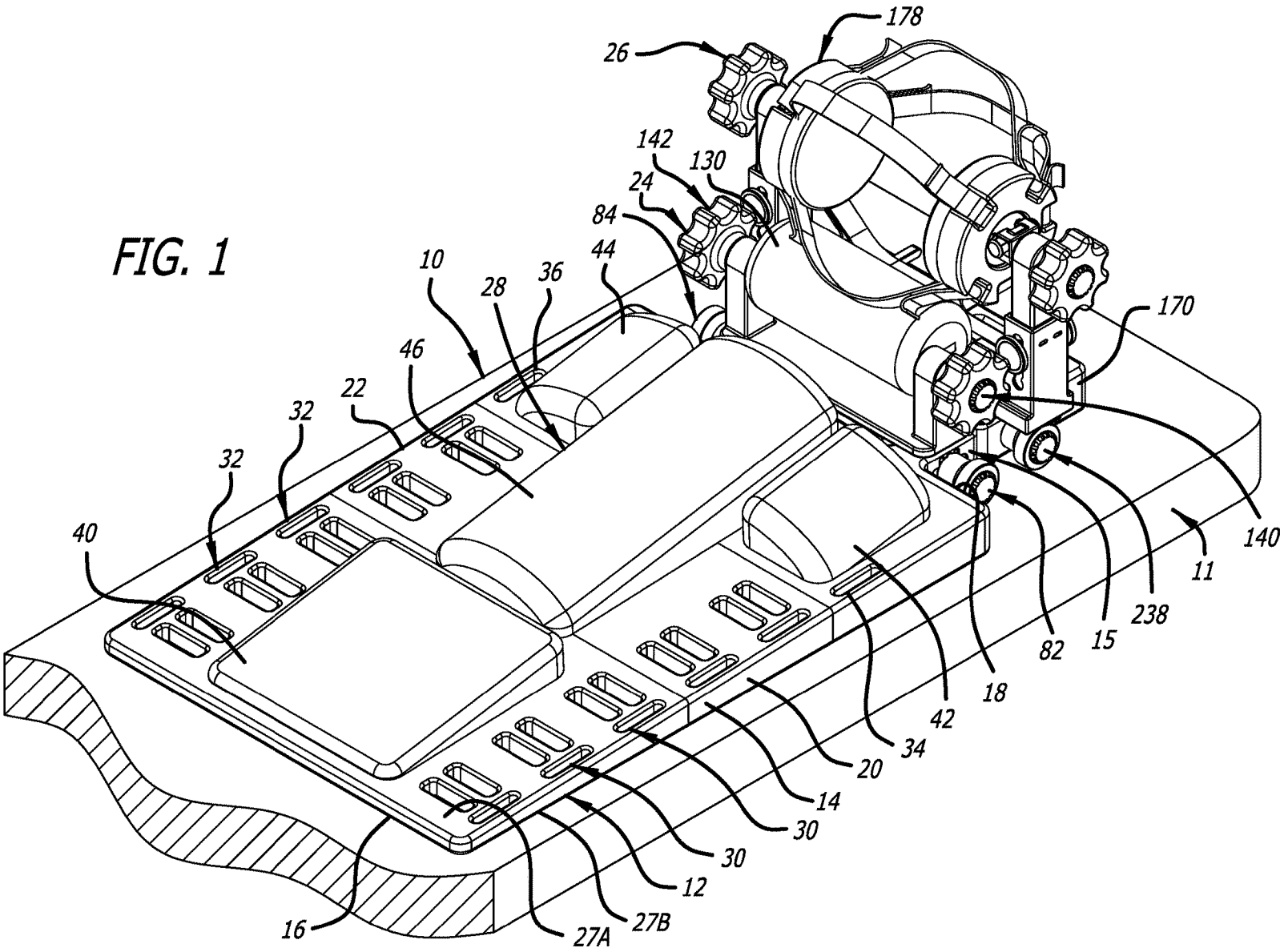
FIG. 1 is a top perspective view that illustrates a device including a back support portion, a neck support portion, and head support portion for supporting portions of a patient thereon positioned on an operating room tabletop.

The present disclosure is directed to a device generally indicated by the numeral 10 in FIG. 1. All or portions of the device 10 can be attachable to or integrated into an operating room table 11 and include various portions for supporting portions of a patient thereon in a supine position. As discussed below, the device 10 includes various componentry for supporting and holding the patient in an optimized position thereon for surgeries including, for example, an anterior cervical discectomy and fusion (ACDF) procedure or an arthroplasty procedure for the cervical spine. To illustrate, the optimized position of the patient for these surgeries can be afforded by creating an optimized sagittal alignment and/or an optimized lordotic curvature of the cervical spine of the patient. The device 10 and the componentry thereof is adjustable to both accommodate differently-sized patients thereon, and adjustable to afford positioning and repositioning of the patient supported thereon before, during, and after surgery.

As depicted in FIG. 1, the device 10 includes a back support portion 12 having a panel portion 14, a docking portion 15, a first end 16, a second end 18, a first lateral side 20, and a second lateral side 22. The panel portion 14 extends between the first lateral side 20 and the second lateral side 22 from the first end 16 toward the second end 18. The panel portion 14 terminates adjacent the second end 18 at a docking portion 15.

As discussed below, a neck support portion 24 and a head support portion 26 are attached relative to the back support portion 12, and the back support portion 12 includes posterior support padding 28 that is attached relative to the panel portion 14. The neck support portion 24, the head support portion 26, and the posterior support padding 28 of the back support portion 12, as their names suggest, are components of the device 10 for supporting corresponding portions of the body of the patient.

If all or portions of the componentry of the device 10 are integrated into the operating room table 11, the panel portion 14 and/or the docking portion 15 of the back support portion 12 can be integrated with the operating room table 11, and the neck support portion 24, the head support portion 26, and the posterior support padding 28 can be attached to the integrated panel portion 14 or the integrated docking portion 15. Alternatively, the neck support portion 24, the head support portion 26, and/or the posterior support padding 28 can be attached directly to portions of the operating room table 11.

Figure 2:
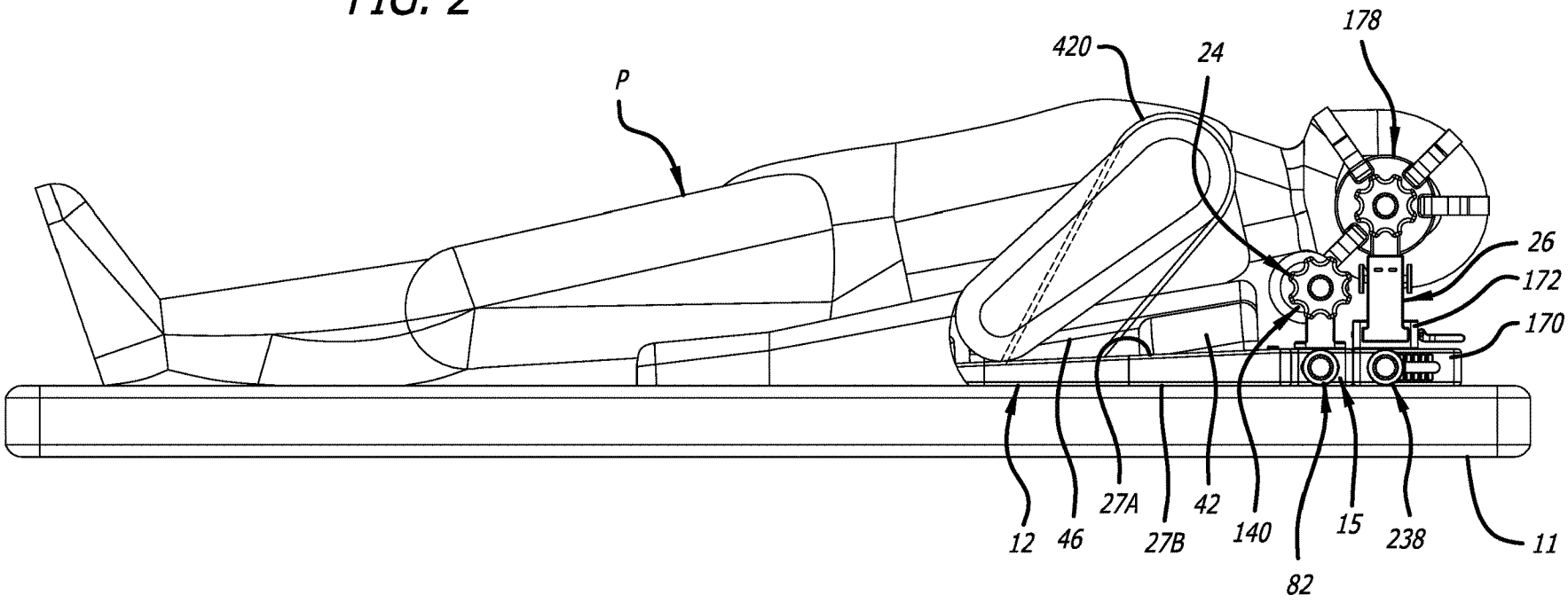
FIG. 2 is a side elevational view that illustrates the device and the operating room tabletop of FIG. 1 showing the patient supported thereon.
Figure 4:
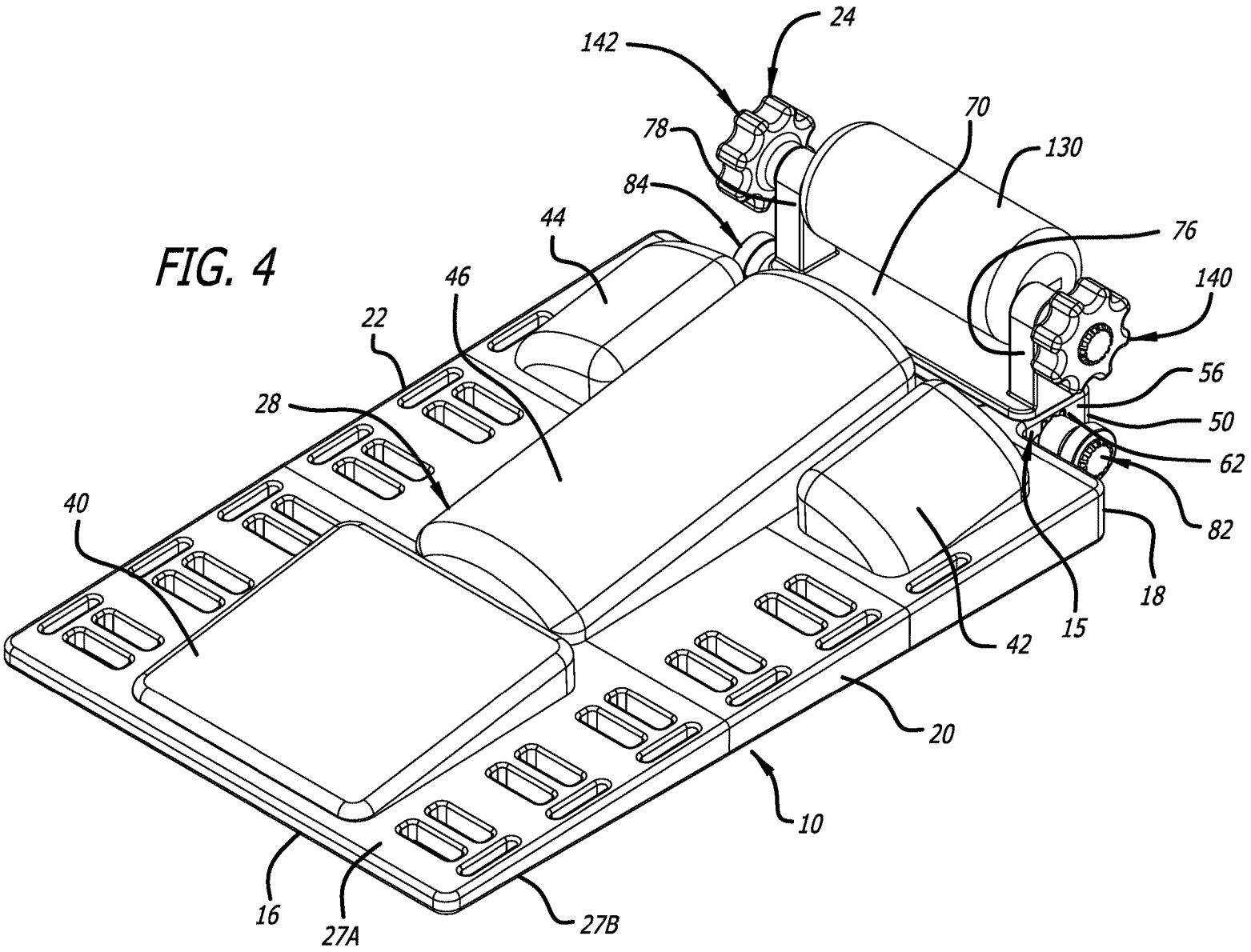
FIG. 4 is a top perspective view that illustrates the back support portion and the neck support portion of FIG. 1.

As depicted in FIGS. 1, 2, and 4, the panel portion 14 includes an upper surface 27A and a lower surface 27B each extending from the first end 16 to adjacent the second end 18 of the device 10. The lower surface 27B can be configured to contact portions of the operating room table 11, and the upper surface 27A can be flattened, curved, or undulated, and can be angled with respect to the lower surface 27B and the floor of the operating room table 11. If all or portions of the componentry of the device 10 are integrated into the operating room table 11, the upper surface 27A is integrated into the upper surface of the operating room table 11 can be flattened, curved, or undulated, and can be angled with respect to the floor of the operating room.

Figure 6:
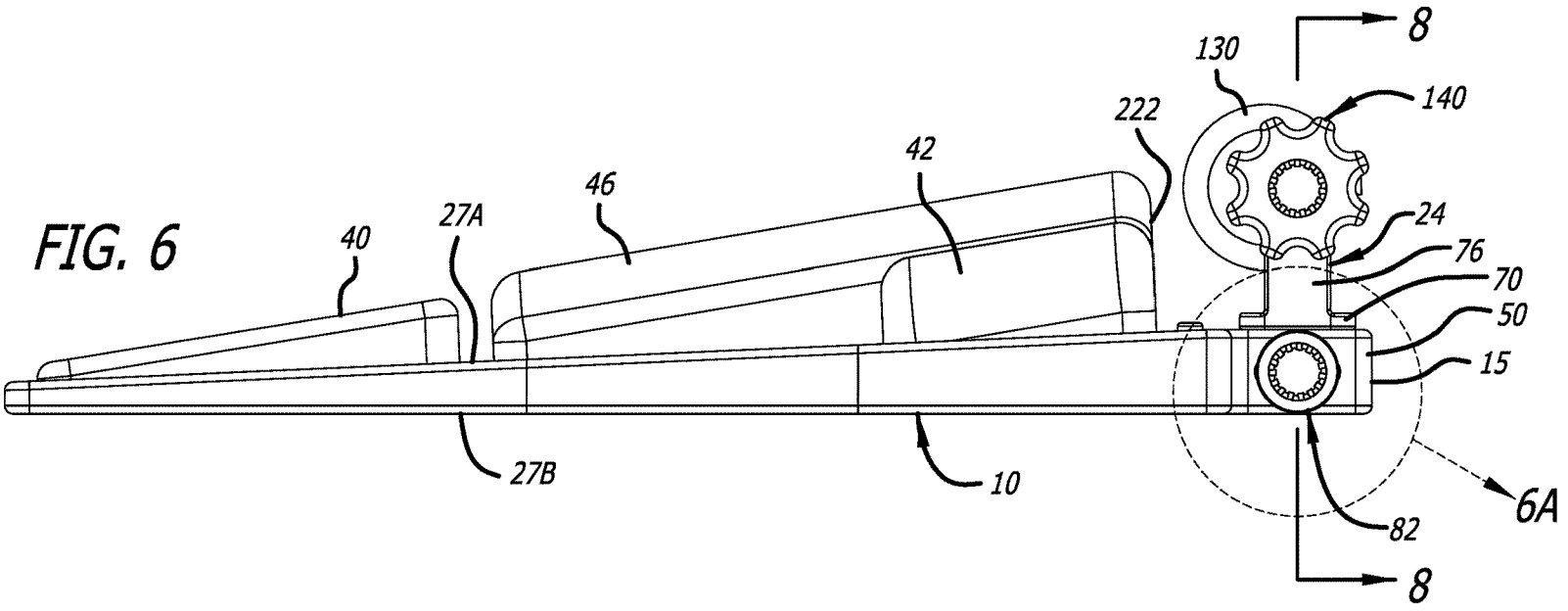
FIG. 6 is a side elevational view that illustrates the back support portion and the neck support portion of FIG. 1.
Figure 7:
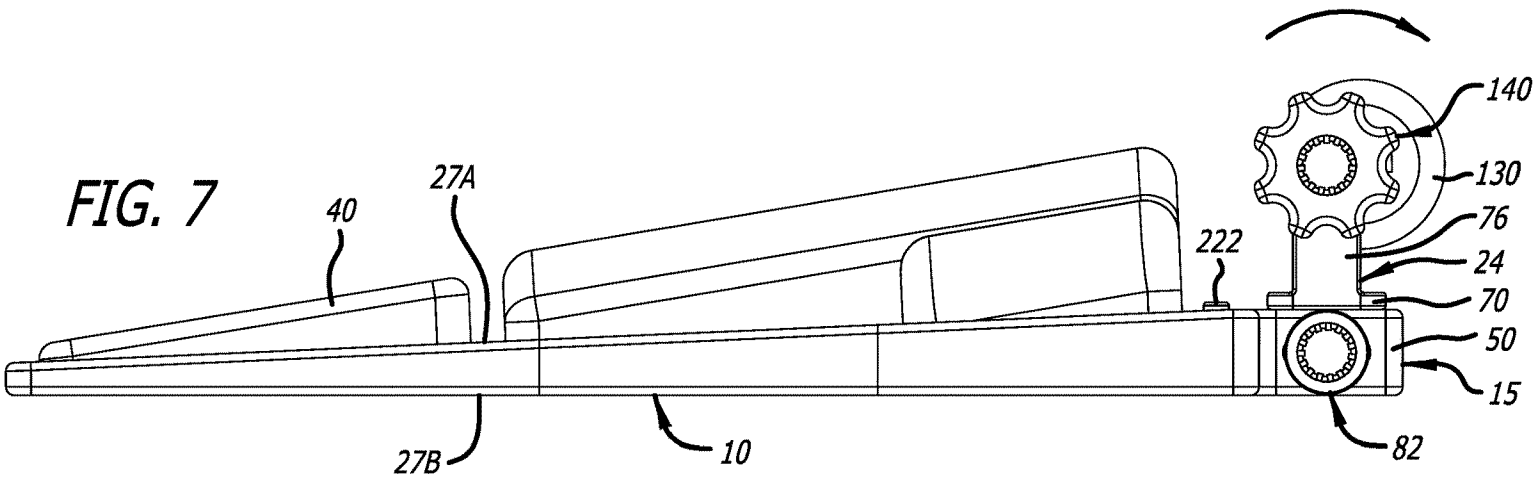
FIG. 7 is a side elevational view similar to FIG. 6 that illustrates repositioning of a pad portion of the neck support portion.

As depicted in FIGS. 1, 4, 6, and 7, the upper surface 27A is substantially flat, and the distance between the lower surface 27B and the upper surface 27A increases as these surfaces extend from the first end 16 to adjacent the second end 18. Furthermore, the angle or angles of the upper surface 27A relative to the lower surface 27B can be constant or varied. For example, rather than the angle therebetween being constant as depicted in FIGS. 6 and 7, the angles of the upper surface 27A relative to the lower surface 27B can increase to provide a curvature or an undulation to the upper surface 27A as these surfaces extend from the first end 16 to adjacent the second end 18. If all or portions of the componentry of the device 10 are integrated into the operating room table 11, the upper surface of the operating room table 11 likewise can be angled.

Figure 5:
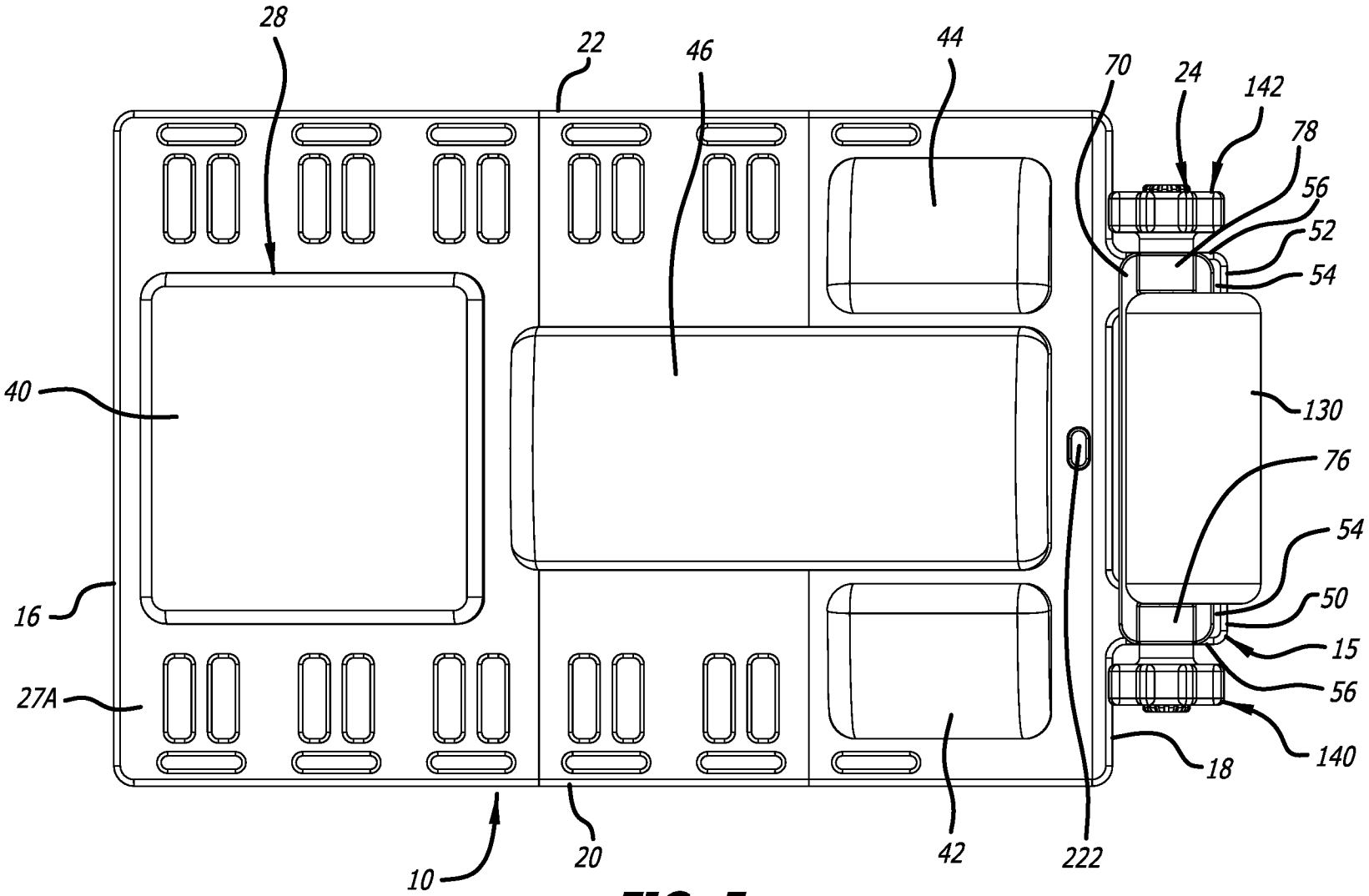
FIG. 5 is a top plan view that illustrates the back support portion and the neck support portion of FIG. 1.

To facilitate attachment to the operating room table 11 or attachment of the patient to the device 10, the panel portion 14 includes a first set of apertures (or slots) 30 arranged along the first lateral side 20 of, and a second set of apertures (or slots) 32 arranged along the second lateral side 22. The first and second sets of apertures 30 and 32 each include one or more apertures or slots. As depicted in FIG. 5, the first and second sets of apertures 30 and 32 each include three (3) apertures or slots. Additional apertures (or slots), such as apertures (or slots) 34 and 36 provided adjacent the second end 18, can be provided adjacent the first end 16, the second end 18, the first lateral side 20, or the second lateral side 22. The first and second sets of apertures 30 and 32, as well as the apertures 34 and 36, can be used to receive straps and tie-downs (not shown) used to secure the device 10 to the operating room table 11 or to secure the patient to the device 10.

As depicted in FIGS. 1 and 4-7, the posterior support padding 28 can include a buttocks support pad 40, a first shoulder support pad 42, a second shoulder support pad 44, and a dorsal support pad 46. All of these pads can be made movably attached to the panel portion 14 and/or to the operating room table 11, and thus, the buttocks support pad 40, the first shoulder support pad 42, the second shoulder support pad 44, and the dorsal support pad 46 can be moved between different positions to accommodate differently-sized patients on the device 10. The adjustments to the various pads of the posterior support padding 28 affords accommodation of differently-sized patients. To illustrate, the various pads can be movable in the direction of the first and second ends 16 and 18, in the direction of the first and second lateral sides 20 and 22, and the heights of pads can be raised or lowered with respect to the upper surface 27A of the panel portion 14 or the upper surface of the operating room table 11. Furthermore, the movement of the various pads can be automated using electrical motors and/or hydraulics/pneumatics, and an operator such as a surgeon can actuate movement thereof using, for example, a foot pedal. After being moved into a proper position, these pads can be secured into position relative to the panel portion 14 and/or to the operating room table 11 to support the patient thereon.

As discussed above, the neck support portion 24 and the head support portion 26 are attached relative to the back support portion 12 and/or the docking portion 15 thereof. The docking portion 15, as depicted in FIG. 5, includes a first portion 50 and a second portion 52 spaced apart from one another at and adjacent the second end 18 of the panel portion 14. Each of the first portion 50 and the second portion 52 include at least an upwardly-facing surface 54 and a outwardly-facing surface 56. Each of the first portion 50 and the second portion 52 includes a first slot 60 and a second slot 62. The first slots 60 begin at the upwardly-facing surfaces 54 and extend through the first portion 50 and the second portion 52, and the second slots 62 begin at the outwardly-facing surfaces 56 and extend through the first portion 50 and the second portion 52. The first slots 60 and the second slots 62 are part of interiors 64 of each of the first portion 50 and the second portion 52. As discussed below, the first slots 60, the second slots 62, and the interiors 64 of the first portion 50 and the second portion 52 are configured to receive portions of the neck support portion 24 to facilitate attachment of the neck support portion 24 to the back support portion 12.

The neck support portion 24 includes a base portion 70, a first leg portion 72, a second leg portion 74, a first arm portion 76, and a second arm portion 78. As discussed below, the neck support portion 24 is movable in the directions of the first end 16 and the second end 18 relative to the first portion 50 and the second portion 52 of the docking portion 15, and the first leg portion 72 and the second leg portion 74 are attachable to the first portion 50 and the second portion 52, respectively. The first leg portion 72 and the second leg portion 74 depend downwardly from the base portion 70. The first leg portion 72 and the second leg portion 74 are spaced apart from one another with the first leg portion 72 being provided adjacent to one end of the base portion 70, and the second leg portion 74 being provided adjacent the other end of the base portion 70. Similarly, the first arm portion 76 and the second arm portion 78 are spaced apart from one another with the first arm portion 76 being provided at and adjacent to one end of the base portion 70, and the second arm portion 78 being provided at and adjacent the other end of the base portion 70.

To facilitate attachment of the neck support portion 24 to the docking portion 15, the first leg portion 72 is received through the first slot 60 of the first portion 50 into the interior 64, the second leg portion 74 is received through the first slot 60 of the second portion 52 into the interior 64, and the base portion 70 is contacted to the upwardly-facing surfaces 54 of the first portion 50 and the second portion 52. Each of the first leg portion 72 and the second leg portion 74 includes an aperture 80, and portions of a first catch-release assembly 82 are received through the second slot 62 of the first leg portion 72 and through the aperture 80 thereof to facilitate engagement thereto, and portions of a second catch-release assembly 84 are received through the second slot 62 of the second leg portion 74 and through the aperture 80 thereof to facilitate engagement thereto.

Each of the first catch-release assembly 82 and the second catch-release assembly 84 includes a hub portion 90, a post portion 92 with a head portion 93, a cap portion 94, a spring portion 96, a washer portion 98, and a nut portion 99. As discussed below, when the first catch-release assembly 82 and the second catch-release assembly 84 are used in attaching the neck support portion 24 to the first portion 50 and the second portion 52, the hub portions 90 of each are movable inwardly and outwardly. In the first position, the first catch-release assembly 82 and the second catch-release assembly 84 secure the first leg portion 72 and the second leg portion 74 of the neck support portion 24 (and hence, the neck support portion 24 itself) in position relative to the first portion 50 and the second portion 52, respectively. And in the second position, the first catch-release assembly 82 and the second catch-release assembly 84 afford movement of the first leg portion 72 and the second leg portion 74 of the neck support portion 24 (and hence, the neck support portion 24 itself) relative to the first portion 50 and the second portion 52, respectively.

For each of the first catch-release assembly 82 and the second catch-release assembly 84, the hub portion 90 includes a first portion 100, a second portion 102, and a third portion 104. The first portion 100 includes an aperture 110 extending therethrough, the second portion 102 and the third portion 104 include an interior cavity 112 extending from the aperture 110 to an opening formed in the third portion 104. Furthermore, the aperture 110 receives a portion of the post portion 92 therethrough, the interior cavity 112 receives a portion of the post portion 92, the spring portion 96, the washer portion 98, the nut portion 99, and a portion of the cap portion 94 therein, and the opening 114 receives a portion of the cap portion 94 therein. For each of the first catch-release assembly 82 and the second catch-release assembly 84, the cap portion 94 is threadably engaged to portions of the hub portion 90 in the interior cavity 112, and the cap portion 94 covers the above-discussed portions of the the first catch-release assembly 82 and the second catch-release assembly 84 received in the interior cavity 112.

For each of the first catch-release assembly 82 and the second catch-release assembly 84, a portion of the post portion 92 extends through one of the second slots 62 and one of the apertures 80, the head portion 93 of the post portion 92 is positioned adjacent to one of the leg portions 72 and 74, and the other end of the post portion 92 is fixedly attached to the nut portion 99 using complimentary threads 106 formed on the post portion 92 and the nut portion 99. The threaded attachment of the post portion 92 to the nut portion 99 of the first catch-release assembly 82 and the threaded attachment of the post portion 92 to the nut portion 99 of the second catch-release assembly 84 serves in capturing the first leg portion 72 and the second leg portion 74 in the interiors 64 of the first portion 50 and the second portion 52, respectively.

Figure 8:
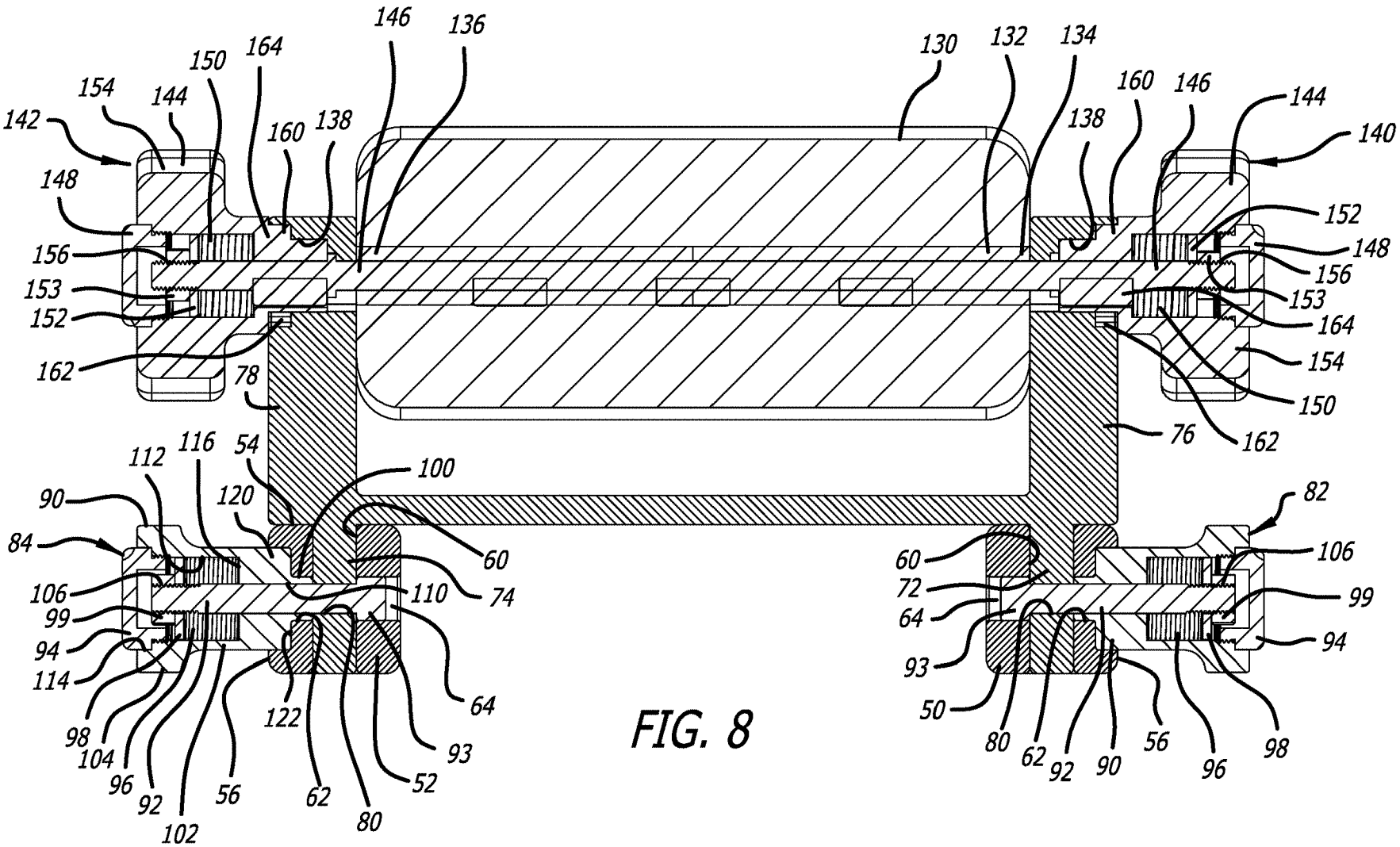
FIG. 8 is a cross-sectional view that illustrates portions of the back support portion and the neck support portion taken along Line 8-8 of FIG. 6.

As depicted in FIG. 8, for each of the first catch-release assembly 82 and the second catch-release assembly 84, the washer portion 98 is positioned between the spring portion 96 and the nut portion 99, and the spring portion 96 is positioned between an end surface 116 of the interior cavity 112 and the washer portion 98. Furthermore, for each of the first catch-release assembly 82 and the second catch-release assembly 84, the hub portion 90 is movable with respect to the post portion 92, the washer portion 98, and the nut portion 99 via interaction of the post portion 92 in the first aperture 110. Additionally, for each of the first catch-release assembly 82 and the second catch-release assembly 84, the spring portion 96 biases the end surface 116 away from the washer portion 98, and hence, biases each of the hub portions 90 of the first catch-release assembly 82 and the second catch-release assembly 84 into the first position.

Given that the first leg portion 72 is received in the first slot 60 of the first portion 50, the second leg portion 74 is received in the first slot 60 of the second portion 52, and the post portion 92 of each of the first catch-release assembly 82 and the second catch-release assembly 84 is received in one of the second slots 62, the neck support portion 24 is movably attached to the first portion 50 and the second portion 52 of the docking portion 15.

Figure 6A:
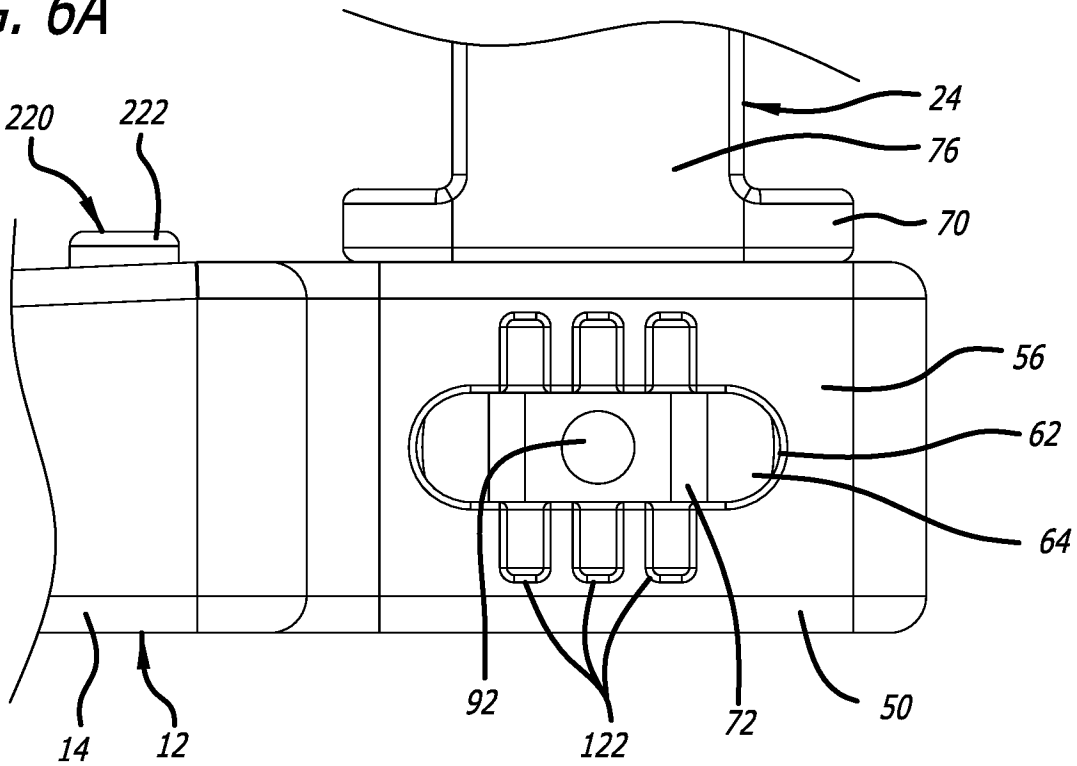
FIG. 6A is an enlarged side elevational view that illustrates portions of the back support portion and the neck support portion depicted in FIG. 6 with a knob of the neck support portion removed.

As depicted in FIG. 8, each of the first catch-release assembly 82 and the second catch-release assembly 84 include catches 120 provided on the hub portion 90 on either side of the first portion 100, and each of the first portion 50 and the second portion 52 includes sets of depressions 122 (FIG. 6A) adjacent the second slots 62. Each set of the depressions 122 are sized to receive the catches 120. Furthermore, each set of the depressions 122 correspond to a different location along the first portion 50 and the second portion 52. When the hub portions 90 of the first catch-release assembly 82 and the second catch-release assembly 84 are in the first position, the catches 120 thereof are engaged to one of the sets of depressions 122 to hold the neck support portion 24 in position relative to the first portion 50 and the second portion 52, and when the first catch-release assembly 82 and the second catch-release assembly 84 are in the second position, the catches 120 are disengaged, and hence, released from the sets of depressions 122, and the neck support portion 24 can slidably move along the first portion 50 and the second portion 52.

To illustrate, a user can pull on each of the first catch-release assembly 82 and the second catch-release assembly 84 by pulling on a handhold formed by the third portion 104. In doing so, the user can move the hub portions 90 of the first catch-release assembly 82 and the second catch-release assembly 84 away from the first positions thereof toward the second positions thereof. The neck support portion 24 can then be slidably moved along the first portion 50 and the second portion 52. Thereafter, the hub portions 90 of each of the first catch-release assembly 82 and the second catch-release assembly 84 are moved back to the first position by the force of the spring portions 96, so that the catches 120 again engage one of the sets of the depressions 122. As such, using the first catch-release assembly 82 and the second catch-release assembly 84, the user can adjust and select the position of the neck support portion 24 (and hence, the neck pad 130) relative to the first portion 50 and the second portion 52 of the docking portion 15, and then fix the neck support portion 24 into the selected position. The position of the neck support portion 24 is selected to correspond to the anatomy of the patient.

The neck support portion 24 also includes a neck pad 130 supported between the first arm portion 76 and the second arm portion 78. The neck pad 130 can include an attachment plate 132 extending at least partially therethrough, and the attachment plate 132 can provide a first lateral attachment point 134 and a second lateral attachment point 136 for attaching a first rotational adjustment assembly 140 and a second rotational adjustment assembly 142 thereto.

The first rotational adjustment assembly 140 and the second rotational adjustment assembly 142 are used to both adjust and select the rotational position of the neck pad 130, and then fix the neck pad 130 into the selected position. Furthermore, because the first lateral attachment point 134 and the second lateral attachment point 136 on the attachment plate 132 are offset from the central axis of the neck pad 130, the neck pad 130 rotates in an eccentric manner causing the neck pad 130 to move upwardly and downwardly and to move toward and away from the first end 16 and the second end 18. The positions of the first lateral attachment point 134 and the second lateral attachment point 136 can be varied along the attachment plate 132. Depending on the location of the first lateral attachment point 134 and the second lateral attachment point 136, the degree of movement of the neck pad 130 upwardly and downwardly, and the degree of movement of the neck pad 130 toward and away from the first end 16 and the second end 18 can be altered.

Each of the first rotational adjustment assembly 140 and the second rotational adjustment assembly 142 includes a hub portion 144, a post portion 146, a cap portion 148, a spring portion 150, a washer portion 152, and a nut portion 153. The post portions 146 can be unitarily formed with or formed separately from one another. As depicted in FIG. 8, the post portions 146 of the first rotational adjustment assembly 140 and the second rotational adjustment assembly 142 are unitarily formed with one another, and the unitarily-formed post portions 146 extend through the attachment plate 132 between the first rotational adjustment assembly 140 and the second rotational adjustment assembly 142. If the post portions 146 are formed separately from one another, end portions of the post portions 146 the first rotational adjustment assembly 140 and the second rotational adjustment assembly 142 can be attached to the attachment plate 132 at the first lateral attachment point 134 and the second lateral attachment point 136, respectively.

Furthermore, the first arm portion 76 and the second arm portion 78 each include an aperture 138 for receiving portions of the unitarily-formed or separately-formed post portions 146 of the first rotational adjustment assembly 140 and the second rotational adjustment assembly 142 therethrough. For the unitarily-formed and the separately-formed post portions 146, complimentary threads 156 formed on the post portion 146 and the nut portion 153 can be used to facilitate attachment thereof in the first rotational adjustment assembly 140, and complimentary threads 156 formed on the post portion 146 and the nut portion 153 can be used to facilitate attachment thereof in the first second adjustment assembly 142. For the separately-formed post portions 146, the post portion 146 of the first rotational adjustment assembly 140 includes also threads (not shown) facilitating fixed attachment to the attachment plate 132 via the first lateral attachment point 134, and the post portion 146 of the second rotational adjustment assembly 142 also includes threads (not shown) facilitating fixed attachment to the attachment plate 132 via the second lateral attachment point 136.

Like the hub portions 90 of the first catch-release assembly 82 and the second catch-release assembly 84, the hub portions 144 of the first rotational adjustment assembly 140 and the second rotational adjustment assembly 142 are movable inwardly and outwardly between a first position and a second position. In the first position, the first rotational adjustment assembly 140 and the second rotational adjustment assembly 142 secure the neck pad 130 in position relative to the first arm portion 76 and the second arm portion 78, respectively. And in the second position, the first rotational adjustment assembly 140 and the second rotational adjustment assembly 142 afford rotational movement of the neck pad 130 relative to the first arm portion 76 and the second arm portion 78, respectively.

The first rotational adjustment assembly 140 and the second rotational adjustment assembly 142 have similar componentry and function similarly to the first catch-release assembly 82 and the second catch-release assembly 84 facilitating movement of the hub portion 144 between the first position and the second position. However, unlike the first catch-release assembly 82 and the second catch-release assembly 84, the hub portions 144 of each of the first rotational adjustment assembly 140 and the second rotational adjustment assembly 142 are rotatable and include a handhold 154 formed thereon for facilitating such rotation. Because at least the hub portion 144 and the post portion 146 each of the first rotational adjustment assembly 140 and the second rotational adjustment assembly 142 are fixed rotationally with respect to one another, rotation of the handholds 154 causes rotation of the post portions 146. Thus, when the handholds 154 are rotated, the post portions 146 are also rotated, and, because the post portions 146 are attached to the attachment plate 132, the neck pad 130 rotates with the handholds 154.

Furthermore, unlike the first catch-release assembly 82 and the second catch-release assembly 84, the hub portion 144 of each of the first rotational adjustment assembly 140 and the second rotational adjustment assembly 142 includes catches 160, and the first arm portion 76 and the second arm portion 78 include sets of depressions 162 adjacent the apertures 138. The catches 160 are spaced circumferentially around an end surface 164 of the hub portion 144, and the sets of depressions 162 are spaced circumferentially around the apertures 138 on the first arm portion 76 and the second arm portion 78.

Each set of the depressions 162 are sized to receive the corresponding catches 160. Furthermore, the sets of depressions 162 correspond to different rotational positions of the hub portions 144 relative to the first arm portion 76 and the second arm portion 78. When the hub portions 144 of the first rotational adjustment assembly 140 and the second rotational adjustment assembly 142 are in the first position, the catches 160 thereof are engaged to at least one of the sets of depressions 162, and when the hub portions 144 of the first rotational adjustment assembly 140 and the second rotational adjustment assembly 142 are in the second position, the catches 160 are disengaged, and hence, released from the sets of depressions 162, and the neck pad 130 can be rotated using the handholds 154.

To illustrate, the user can pull on each of the first rotational adjustment assembly 140 and the second rotational adjustment assembly 142 by pulling on the handholds 154. In doing so, the user can move the hub portions 144 of the first rotational adjustment assembly 140 and the second rotational adjustment assembly 142 away from the first positions thereof toward the second positions thereof. The neck pad 130 can then be rotated by rotating the handholds 154. Thereafter, the hub portions 154 of each of the first rotational adjustment assembly 140 and the second rotational adjustment assembly 142 are moved back to the first position by the force of the spring portions 150, so that the catches 160 again engage at least one of the sets of the depressions 162. As such, using the first rotational adjustment assembly 140 and the second rotational adjustment assembly 142, the user can adjust and select the rotational position of the neck pad 130 relative to the first arm portion 76 and the second arm portion 78, and then fix the neck pad 130 into the selected position. The position of the neck pad 130 is selected to correspond to the anatomy of the patient.

The head support portion 26 includes a first base portion 170, a second base portion 172, a first arm portion 174, a second arm portion 176, and a head harness 178. As discussed below, the first base portion 170 is movably attached to the back support portion 12, the second base portion 172 is movable in the directions of the first end 16 and the second end 18 with respect to the first base portion 170, the first arm portion 174 and the second arm portion 176 are movable inwardly and outwardly with respect to the second base portion 172, the first arm portion 174 and the second arm portion 176 are capable of telescoping, and the head harness 178 is rotatable relative to the first arm portion 174 and the second arm portion 176.

To facilitate attachment of the head support portion 26 to the back support portion 12, the first base portion 170 includes a extension portion 180 and a tongue portion 182 extending outwardly from the extension portion 180. The extension portion 180 includes a first side surface 184 and a second side surface 186 configured to interface with a first inner surface 190 of the first portion 50 and a second inner surface 192 of the second portion 52, respectively. Furthermore, the extension portion 180 is sized to fit between the first portion 50 and the second portion 52 of the docking portion 15, and the tongue portion 182 is sized to fit within a similarly-sized cavity 188 formed in the back support portion 12 between the first portion 50 and the second portion 52.

One of the first side surface 184 and the first inner surface 190, and one of the second side surface 186 and the second inner surface 192 can include a slot (not shown) for receiving a protrusion (not shown) formed on the other of the first side surface 184 and the first inner surface 190, and the other of the second side surface 186 and the second inner surface 192. The receipt of the protrusions in the slots and interaction therebetween can serve controlling movement of the extension portion 180 relative to the first portion 50 and the second portion 52 to correspondingly guide insertion of the tongue portion 182 into the cavity 188, and can afford resistance of upward and downward movement of the first base portion 170 relative to the back support portion 12.

Figure 9:
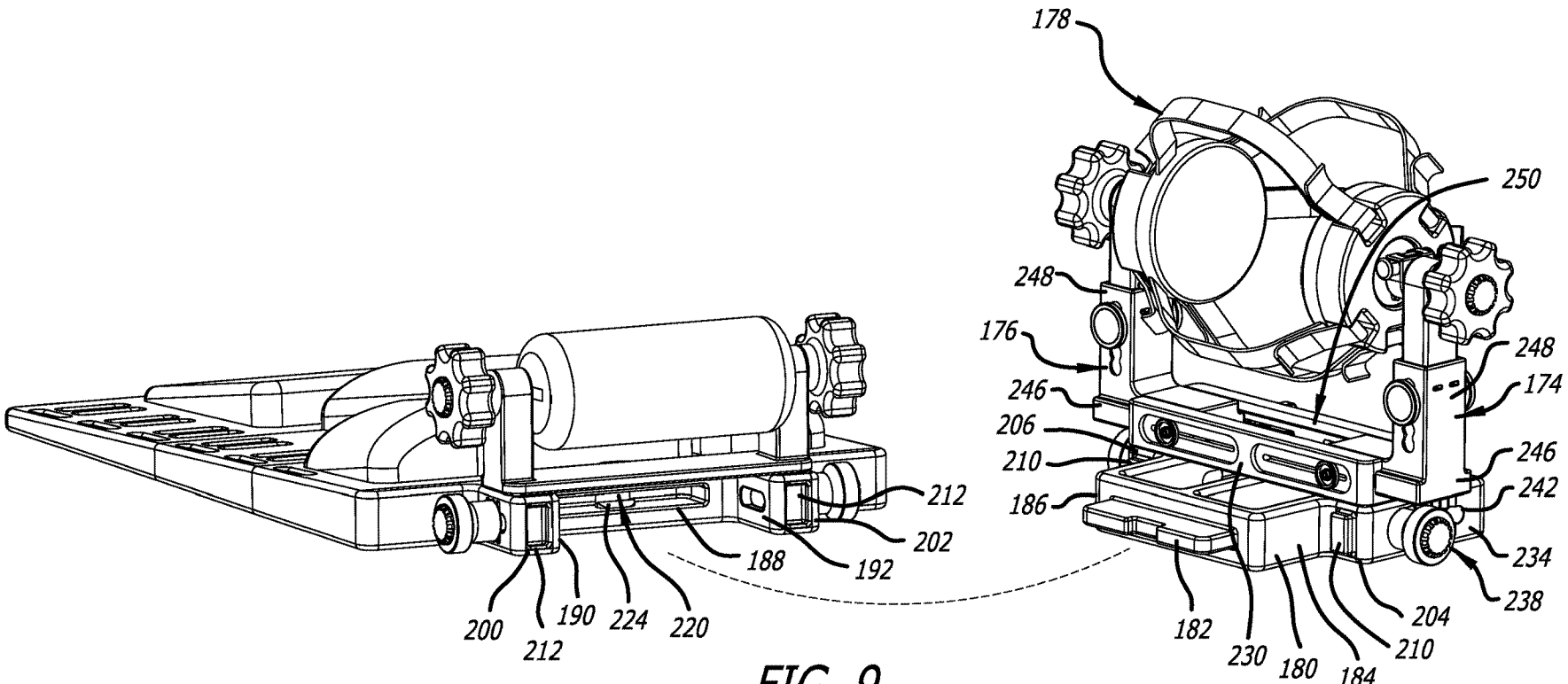
FIG. 9 is a side perspective view that illustrates the head support portion being attached to the back support portion and the neck support portion of FIG. 1.

In addition to or in place of the slots and protrusion, the first portion 50 and the second portion 52 of the docking portion 15 can include slots or protrusions, and the first base portion 170 can include complementary slots or protrusions for engagement therewith. To illustrate, the first portion 50 includes a first end surface 200 and the second portion 52 can include a second end surface 202, and the first base portion 170 can include a first surface 204 adjacent the extension portion 180 and a second surface 206 adjacent the extension portion 180. One of the first end surface 200 and the first surface 204, and one of the second end surface 202 and the second surface 206 can include a slot for receiving a protrusion formed on the other of the first end surface 200 and the first surface 204, and the other of the second end surface 202 and the second surface 206. As depicted in FIG. 9, the first surface 204 and the second surface 206 each include a protrusion 210, and the first end surface 200 and the second end surface 202 each include a slot 212. The receipt of the protrusions 210 in the slots 212 and the interaction therebetween can afford resistance of upward and downward movement of the first base portion 170 relative to the back support portion 12.

The back support portion 12 can include an attachment mechanism 220 for securing the first base portion 170 in relation thereto. The attachment mechanism 220 can include a button portion 222 and a catch portion 224 for engaging a complementary structure (not shown) formed on the tongue portion 182. To illustrate, when the tongue portion 182 is inserted into the cavity 188, the catch portion 224 is engaged to the complementary structure to hold the tongue portion 182 in position relative to the back support portion 12. The button portion 222 can be actuated to release the catch portion 224 from the complementary structure, and afford removal of the tongue portion 182 from the cavity 188. Removal of the tongue portion 182 from the cavity allows the head support portion 26 to be detached from the back support portion 12.

To facilitate attachment of the second base portion 172 to the first base portion 170, the second base portion 172 includes a body portion 230 and a first leg portion (not shown) and a second leg portion (not shown) depending downwardly from the body portion 230. The body portion 230 can rest on an upper surface 232 of the first base portion 170, the first leg portion and the second leg portion of the second base portion 172 can be received in third slots (not shown) in the upper surface 232 and into an interior (not shown) of the first base portion 170. One of the third slots is provided adjacent a third side surface 234 of the first base portion 170, and another of the third slots is provided adjacent a fourth side surface 236 of the first base portion 170. The third slots formed in the upper surface 232 of the first base portion 170 are similar to the first slots 60 formed in the first portion 50 and the second portion 52.

Figure 10:
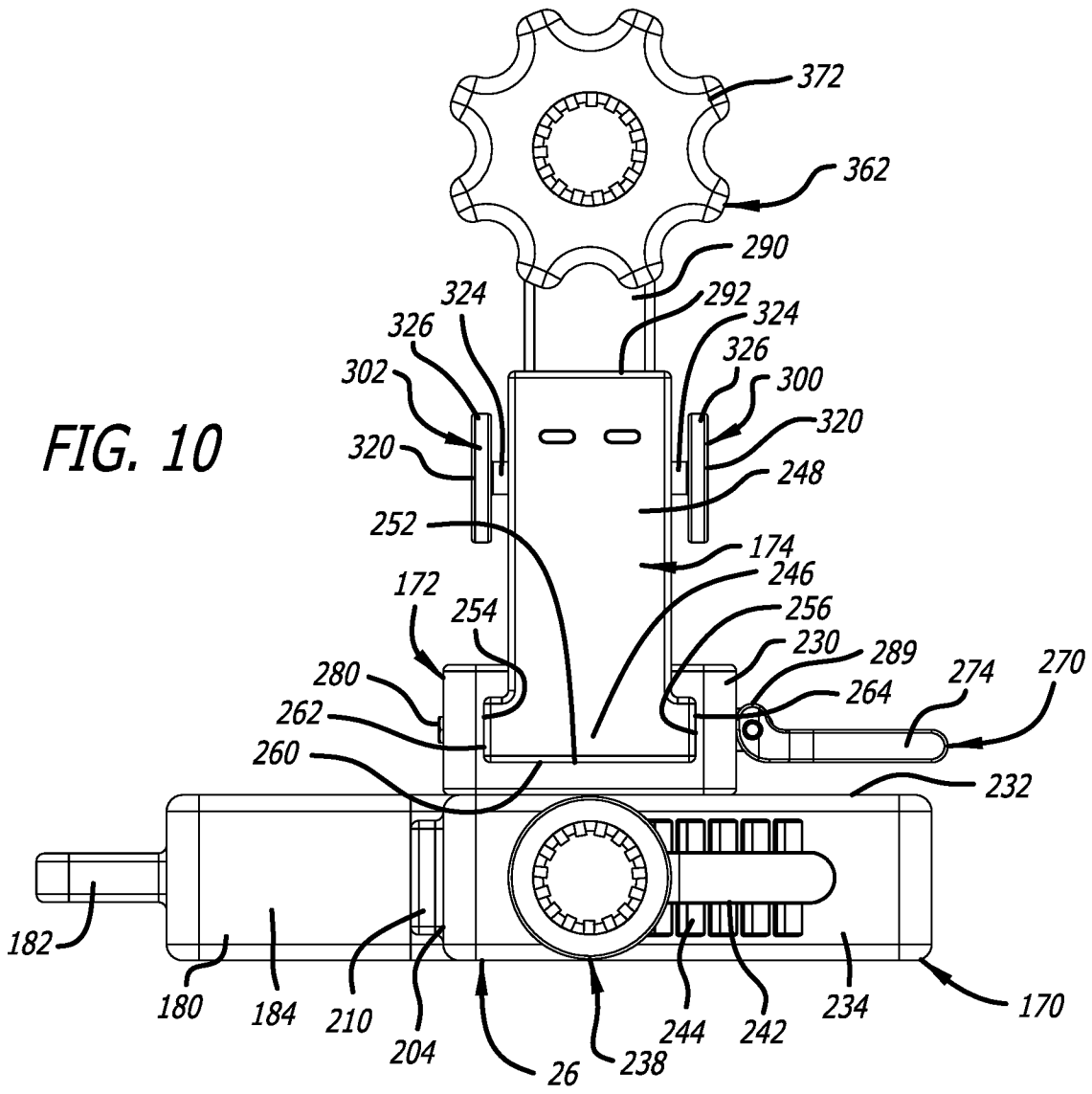
FIG. 10 is a side elevational view of the head support portion of FIG. 1.
Figure 11:
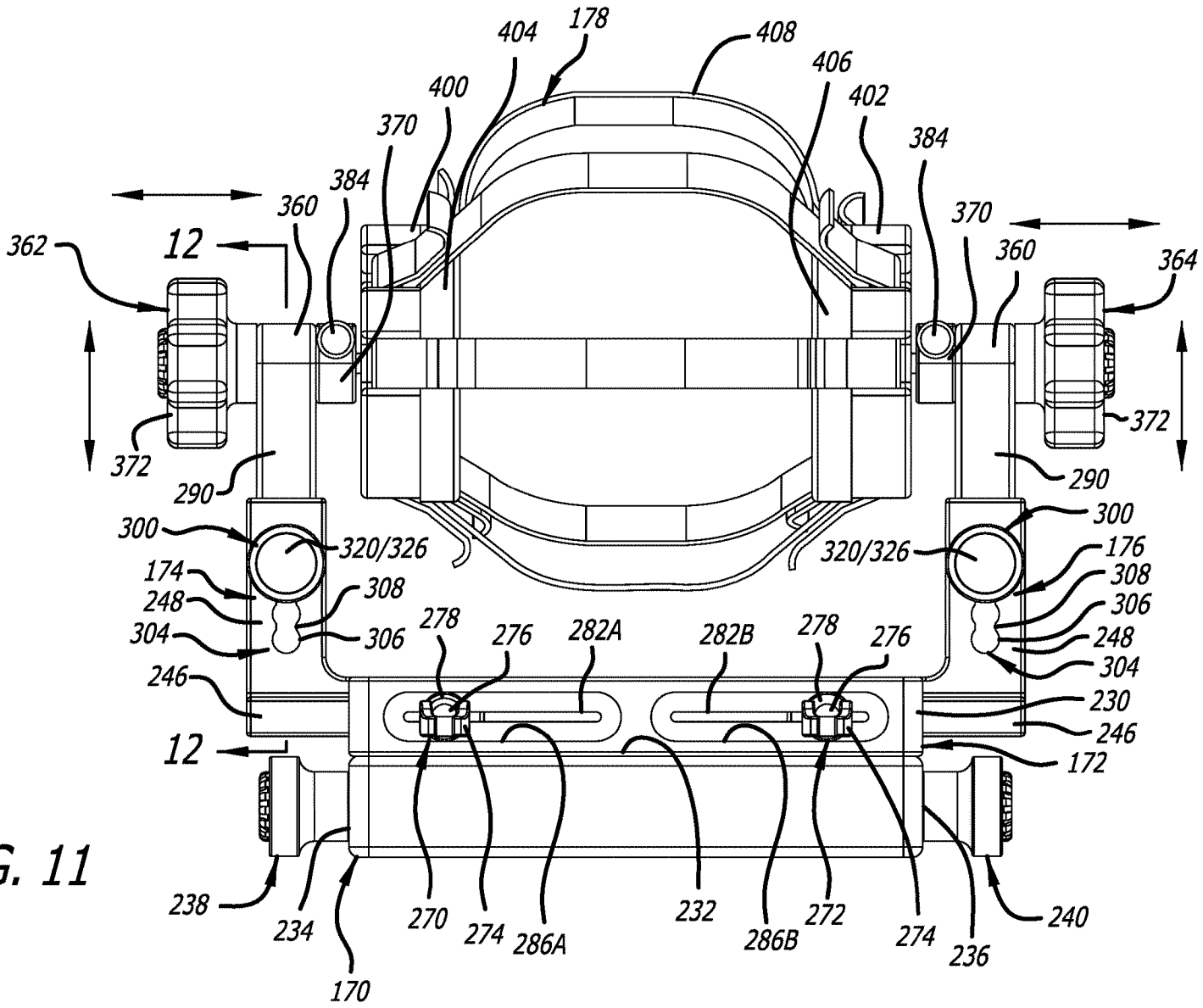
FIG. 11 is a rear elevational view that illustrates the head support portion of FIG. 1.

In similar fashion to the first catch-release assembly 82 and the second catch-release assembly 84, a third catch-release assembly 238 and a fourth catch-release assembly 240, as depicted in FIGS. 9-11, can be used to facilitate movement of the second base portion 172 relative to the first base portion 170. In similar fashion to the first catch-release assembly 82 and the second catch-release assembly 84, portions of the third catch-release assembly 238 and the fourth catch-release assembly 240 are received through fourth slots 242 similar to the second slots 62 to engage the first leg portion and the second leg portion of the second base portion 172. The fourth slots 242 are formed in each of the third side surface 234 and the fourth side surface 236 of the first base portion 170.

In a first position, each of the third catch-release assembly 238 and the fourth catch-release assembly 240 secure the first leg portion and the second leg portion of the second base portion 172 (and hence, the second base portion 172) in position relative to the first base portion 170. And in a second position, each of the third catch-release assembly 238 and the fourth catch-release assembly 240 afford movement of the first leg portion and the second leg portion of the second base portion 172 (and hence, the second base portion itself) relative to the first base portion 170. The third side surface 234 and the fourth side surface 236 each include sets of depressions 244 adjacent the fourth slots 242 sized to receive catches (not shown) formed on the each of the third catch-release assembly 238 and the fourth catch-release assembly 240. Like the catches 120 and the sets of depressions 122, the engagement of the catches of the third catch-release assembly 238 and the fourth catch-release assembly 240 to one of the sets of depressions 244 serves in holding the second base portion 172 in position relative to the first base portion 170, and the disengagement of the catches of the third catch-release assembly 238 and the fourth catch-release assembly 240 from one of the sets of depressions 244 affords slidable movement of the second base portion 172 on the first base portion 170. As such, using the third catch-release assembly 238 and the fourth catch-release assembly 240, the user can adjust and select the position of the second base portion 172 (and hence, the first arm portion 174 and the second arm portion 176) relative to the first base portion 170, and then fix the second base portion 172 into the selected position.

In addition to second base portion 172 being slidably movable with respect to the first base portion 170, the first arm portion 174 and the second arm portion 176 are slidably movable with respect to the second base portion 172. Each of the first arm portion 174 and the second arm portion 176 include a first portion 246 and a second portion 248 attached to one another. The first portions 246 and second portions 248 can form an "L" shape, and can be perpendicularly oriented with respect to one another. As depicted in FIGS. 9-11, the first portions 246 are oriented horizontally, and the second portions 248 are oriented vertically.

The first portions 246 are received in a cavity 250 formed in the second base portion 172 that extends between the lateral sides thereof. The cavity 250 includes a bottom surface 252, a first substantially vertical surface 256, and a second substantially vertical surface 254, and the first portions 246 each include a lower surface 260, a first substantially vertical surface 262, and a second substantially vertical surface 264. When the first portions 246 of the first arm portion 174 and the second arm portion 176 are received in the cavity 250, the lower surfaces 260 interface with the bottom surface 252 of the cavity 250, the first substantially vertical surfaces 262 interface with the first substantially vertical surface 254, and the second substantially vertical surfaces 264 interface with the second substantially vertical surface 256. The first substantially vertical surface 254 and the first substantially vertical surfaces 262, and the second substantially vertical surface 256 and the second substantially vertical surfaces 264 can include complementary surfaces that serve in capturing the first portions 246 in the cavity 250 by preventing movement thereof in the directions of the first end 16 and the second end 18, but afford also movement thereof in directions perpendicular to the directions of the first end 16 and the second end 18.

The movement of the first portions 246 in directions perpendicular to the directions of the first end 16 and the second end 18 affords corresponding movement inwardly and outwardly of the second portions 248 relative to the second base portion 172. As such, the positions of the second portions 248 can be adjusted via such movement. The positions of the first portions 246 of the first arm portion 174 and the second arm portion 176 can be fixed using a first lever lock 270 and a second lever lock 272, respectively.

Each of the first lever lock 270 and the second lever lock 272 includes a handle portion 274, a ball portion 276 pinned to the handle portion 274, a washer portion 278 contacting the body portion 230 and positioned between the ball portion 276 and the body portion 230, a nut/washer portion 280 contacting the body portion 230, and a shaft portion (not shown) extending between the ball portion 276 and the nut/washer portion 280. The shaft portion of the first lever lock 270 extends through a first shaft-receiving slot 282A formed on one side of the body portion 230, through an aperture (not shown) formed in the first portion 246 of the first arm portion 174, and through a second shaft-receiving slot 284A formed on the opposite side of the body portion 230, and the shaft portion of the second lever lock 272 extends through a first shaft-receiving slot 282B formed on one side of the body portion 230, through an aperture (not shown) formed in the first portion 246 of the second arm portion 176, and through a second shaft-receiving slot 284B formed on the opposite side of the body portion 230. The washer portions 278 can be received in and slidable along first recesses 286A and 286B, and the nut/washer portions 280 can be received in and slidable along second recesses 288A and 288B.

The handle portions 274 are pivotally attached to the ball portions 276. Each of the handle portions 274 are at least pivotal between a first position and a second position. In the first position, the handle portions 274 extend horizontally from the body portion 230, and in the second position, the handle portions 274 can extend vertically from the body portion 230. Each of the handle portions 274 include a cam surface 289 at the end thereof adjacent the ball portions 276. As the handle portions 274 are moved from the first positions to the second positions, the camming surfaces 289 contact the washer portions 278, and the resulting camming action moves the ball portions 276 away from the washer portions 278. Such movement pulls on the shaft portions to lock the first portions 246 in position relative to the body portion 230. As such, when the handle portions 274 are in the first positions thereof, the first portions 246 (and hence, the first arm portion 174 and the second arm portion 176) are capable of slidable movement in the cavity 250. And, when the handle portions 274 are in the second positions thereof, the first portions (and hence, the first and second arm portions 174 and 176) are locked in position. As such, using the first lever lock 270 and the second lever lock 272, the user can adjust and select the position of the first arm portion 174 and the second arm portion 176 relative to the second base portion 172, and then fix the first arm portion 174 and the second arm portion 176 into the selected position.

Figure 12A:
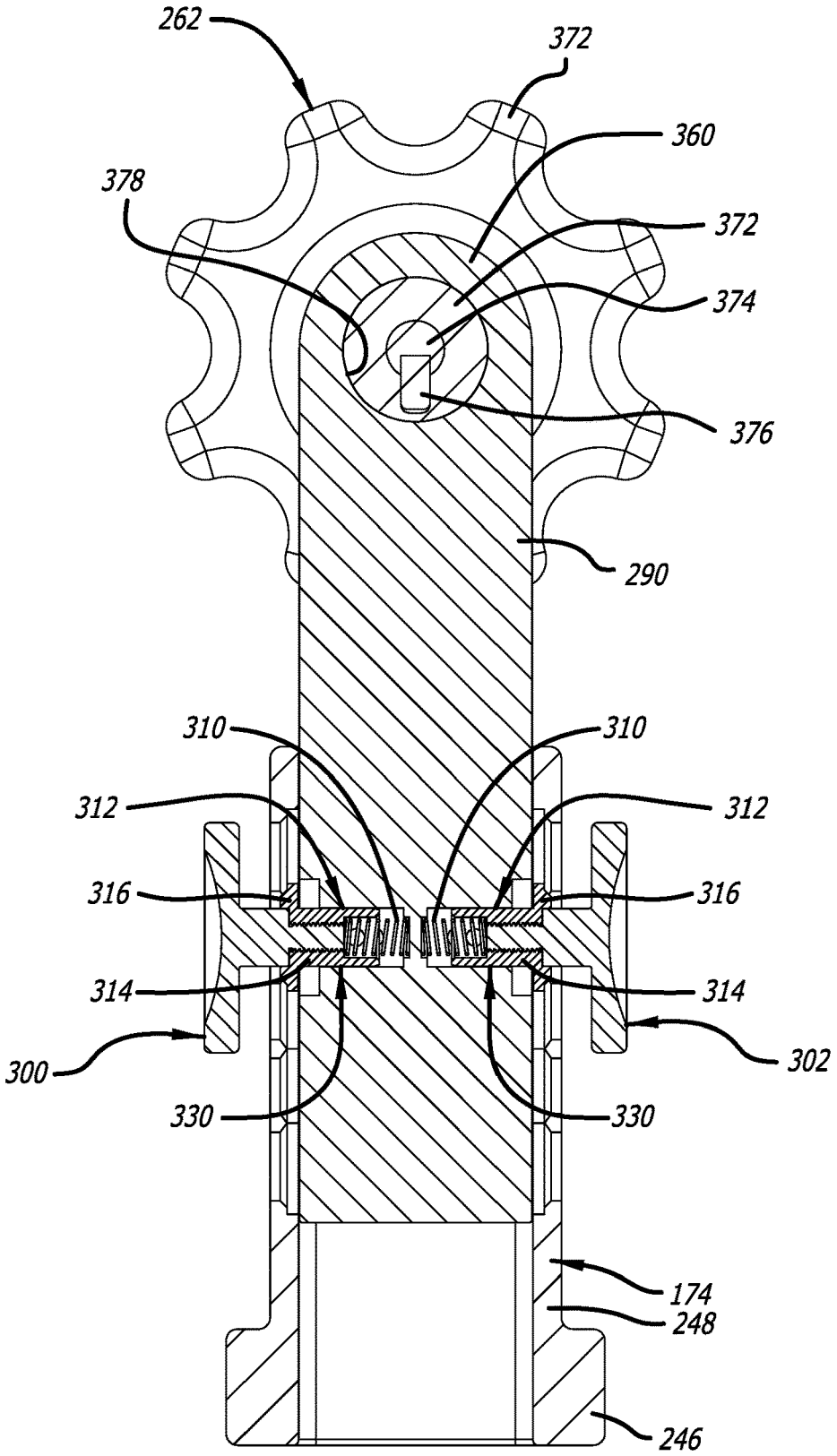
FIG. 12A is a cross-sectional view that illustrates the portion of the head support of FIG. 1 taken alone Line 12-12 of FIG. 11.
Figure 12B:
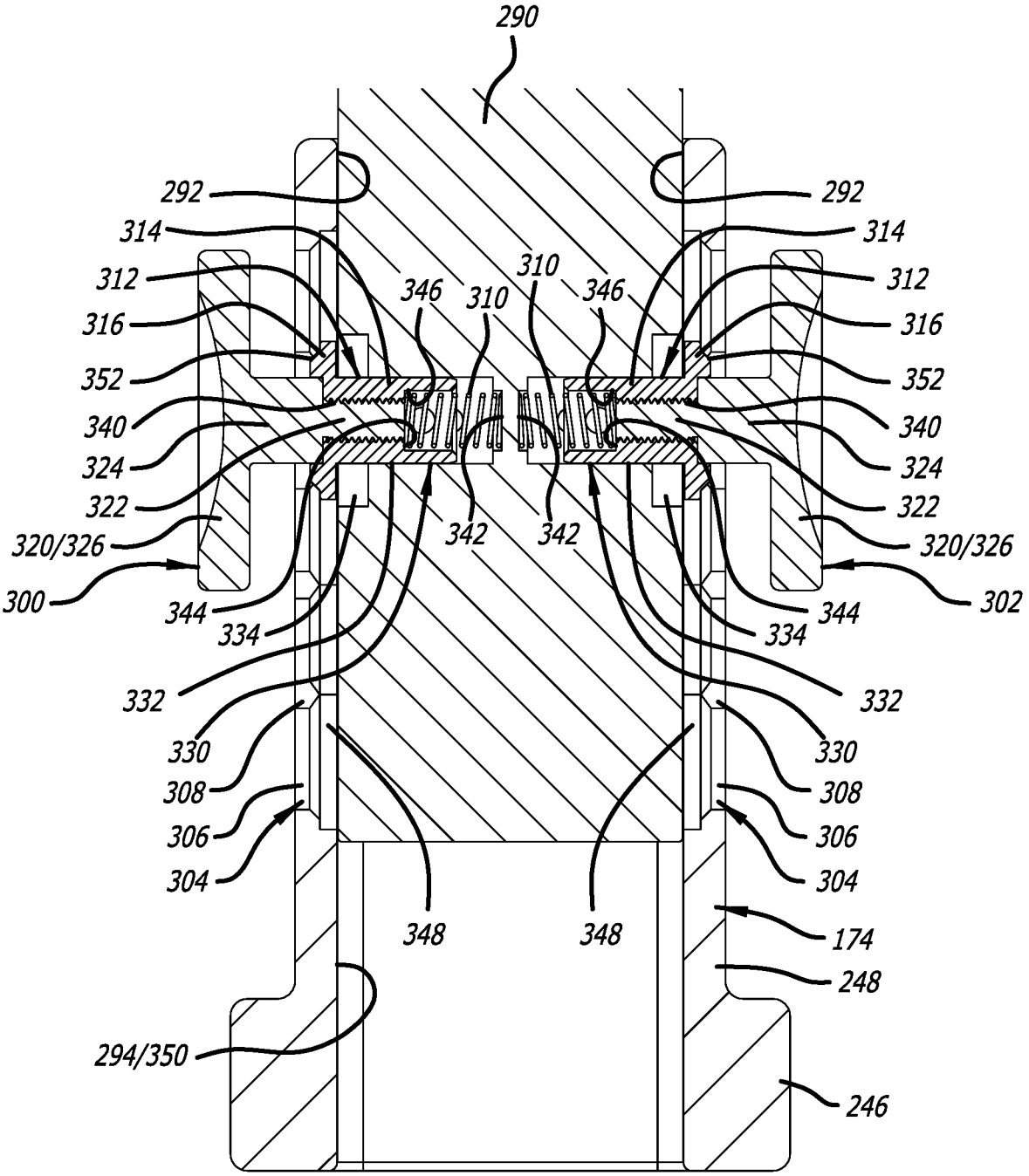
FIG. 12B is an enlarged cross-sectional view of FIG. 12A.
Figure 13:
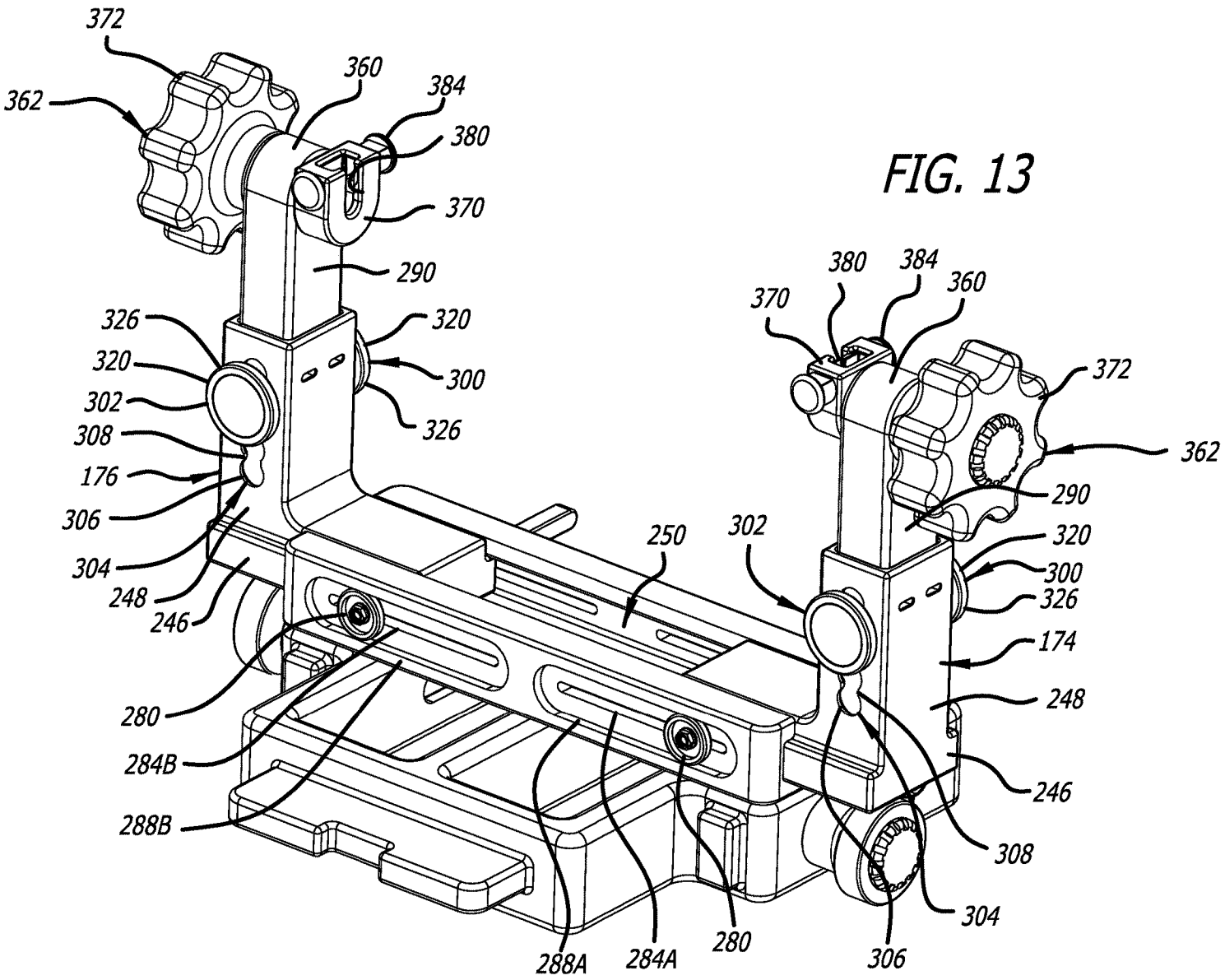
FIG. 13 is a top perspective view that illustrates the head support portion of FIG. 1.

In addition to the first portions 246 and the second portions 248, the first arm portion 174 and the second arm portion 176 each include a third portion 290. The third portions 290 are movable downwardly and upwardly with respect to the second portions 248. To illustrate, each of the second portions 248 include an opening 292 and an interior cavity 294 accessed through the opening 292. As depicted in FIG. 12B, the third portions 290 are received through the openings 292 and into the interior cavities 294 of the second portions 248, and thus, the third portions 290 are movable inwardly (downwardly) and outwardly (upwardly) of interior cavities 294 of the second portions 248.

As depicted in FIGS. 9-13, the first arm portion 174 and the second arm portion 176 each include a first adjustment mechanism 300 and a second adjustment mechanism 302, respectively, affording fixed positioning of the third portions 290 relative to the second portions 248 at various positions. The various positions correspond to different heights of the third portions 290 relative to the second portions 248. Each of the first adjustment mechanism 300 and the second adjustment mechanism 302, as depicted in FIG. 12B, include slots 304 including enlarged portions 306 and connecting portions 308 joining the enlarged portions 306 on the second portions 248. Each of the first adjustment mechanism 300 and the second adjustment mechanism 302 further include a spring portion 310; a collar portion 312 including a shaft portion 314 and a flange portion 316; and a button portion 320 having a first post portion 322, a second post portion 324, and a knob portion 326. Each of the first adjustment mechanism 300 and the second adjustment mechanism 302 still further include an aperture 330 (FIGS. 12A and 12B) having a first portion 332 and a second portion 334 formed in the third portion 290.

As depicted in FIG. 12B, for each of the first adjustment mechanism 300 and the second adjustment mechanism 302, the first post portion 322 and the second post portion 324 of the button portion 320 are received through the slot 304, the button portion 320 is attached to the collar portion 312 via threaded engagement of the first post portion 322 in a first cavity 340 formed in the collar portion 312; the spring portion 310 is positioned between an end wall 342 of the aperture 330 and an end wall 344 formed in a second cavity 346 formed in the collar portion 312. The spring portion 310 biases the collar portion 312 and the button portion 320 outwardly with respect to the third portion 290.

For each of the first adjustment mechanism 300 and the second adjustment mechanism 302, the collar portion 312 and the button portion 320 are movable between an undepressed first position (FIG. 12B) and a depressed second position, and the spring portion 310 biases the collar portion 312 and the button portion 320 into the undepressed first position. Each of the enlarged portions 306 of the slots 304 includes an interior surface detail 348 formed on an interior surface 350 of the interior cavity 294. In the undepressed first position of the collar portion 312 and the button portion 320, an exterior surface 352 of the flange portion 316 contacts one of the interior surface details 348 to hold the third portion 290 relative to the second portion 248. In the depressed second portion of the collar portion 312 and the button portion 320, the exterior surface 352 is disengaged from the interior surface details 348, and the second post portion 324 is slidable within the slot 304 to afford downward and upward movement of the third portion 290 relative to the second portion 248. Actuation of the first adjustment mechanism 300 and the second adjustment mechanism 302 in this manner allows the height of the third portion 290 to be selected. As such, using the first adjustment mechanisms 300 and the second adjustment mechanisms 302, the user can adjust and select positions of the third portions 290 relative to the second portions 248, and then fix the third portions 290 into the selected heights.

Adjustment of the heights of the third portions 290 relative to the second portions 248 affords corresponding adjustment of the heights of end portions 360 of the third portions 290. The end portion 360 of the third portion 290 of the first arm portion 174 includes a first attachment assembly 362, and the end portion 360 of the third portion 290 of the second arm portion 176 includes a second attachment assembly 364. The first attachment assembly 362 and the second attachment assembly 364 facilitate attachment of the head harness 178 to the first arm portion 174 and the second arm portion 176.

Each of the first attachment assembly 362 and the second attachment assembly 364 includes a collar portion 370, a handle/hub portion 372, an axle portion 374 interconnecting the collar portion 370 and the handle/hub portion 372, and a key portion 376 attaching the handle/hub portion 372 and the axle portion 374. An aperture 378 is formed in each of the end portions 360 for receiving one of the collar portions 370 and one of the axle portions 374 therethrough, and the collar portions 370 and the handle/hub portions 372 are positioned adjacent opposite sides of the apertures 378. The first attachment assembly 362 and the second attachment assembly 364 and the handle/hub portions 372 can function identically to the first rotational adjustment assembly 140 and the second rotational adjustment assembly 142.

Because the collar portion 370 and the handle/hub portion 372 are interconnected, the user can turn the handle/hub portion 372 to correspondingly turn the collar portion 370. Furthermore, the collar portions 370 each include a keyway 380 for receiving keys 382 included on the head harness 178. The head harness 178 can be attached to the first attachment assembly 362 and the second attachment assembly 364 (and hence, attached relative to the first arm portion 174 and the second arm portion 176) via the interaction of the keys 382 in the keyways 380, and the use of clamps 384 provided on each of the collar portions 370. The clamps 384 can be used to physically secure the keys 382 in the keyways 380. Thus, rotation of the handle/hub portions 372 also serves to rotate the head harness 178.

Figure 14:
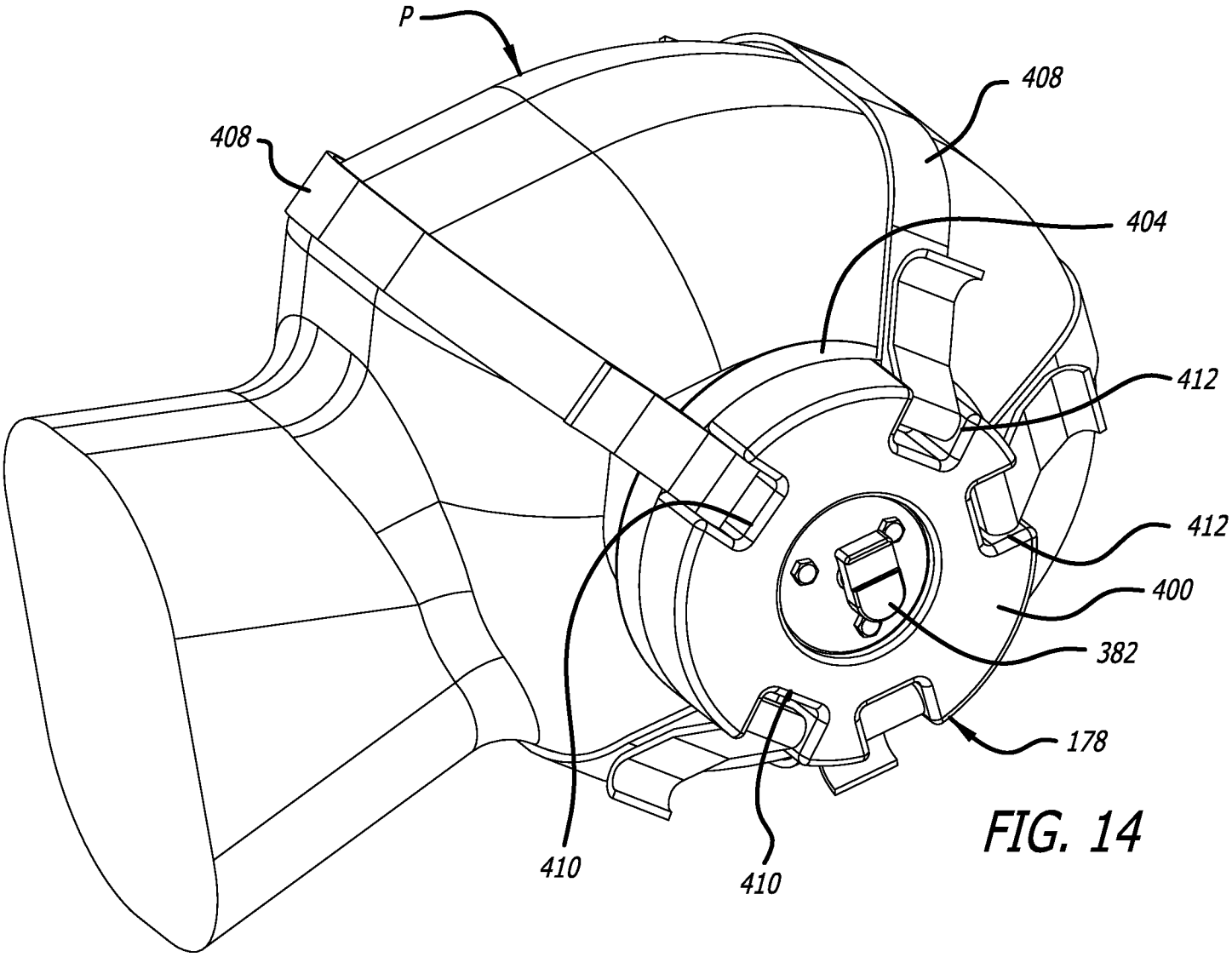
FIG. 14 is a top perspective view that illustrates a harness portion of the head support portion of FIG. 1.

The head harness 178 is used to hold the patient's head therein. As depicted in FIGS. 11 and 14, in addition to the keys 382, the head harness 178 includes a first hub 400, a second hub 402, a first pad 404, a second pad 406, and various straps 408. The first pad 404 and the second pad 406 are configured to contact the sides of the head of the patient. The first pad 404 is attached to the first hub 400, and the second pad 406 is attached to the second hub 402, and the keys 382 are provided on the first hub 400 and the second hub 402 opposite from the first pad 404 and the second pad 406, respectively. As discussed above, the keys 382 are receivable in the keyways 380 to facilitate attachment of the head harness 178 relative to the first arm portion 174 and the second arm portion 176.

Each of the first hub portion 400 and the second hub portion 402 includes various depressions 410 spaced around the perimeter thereof, and various attachment points 412 in the depressions 410. The attachment points 412 facilitate attachment of the various straps 408 thereto. Each of the various straps 408 extend between the first hub 400 and the second hub 402, and serve in attaching the head harness 178 to the head of the patient. The ends of each of the various straps 408 can be looped around the attachment points and secured in position using interfacing pieces of Velcro®. In doing so, the various straps 408 can be tightened against the head of the patient.

Figure 3:
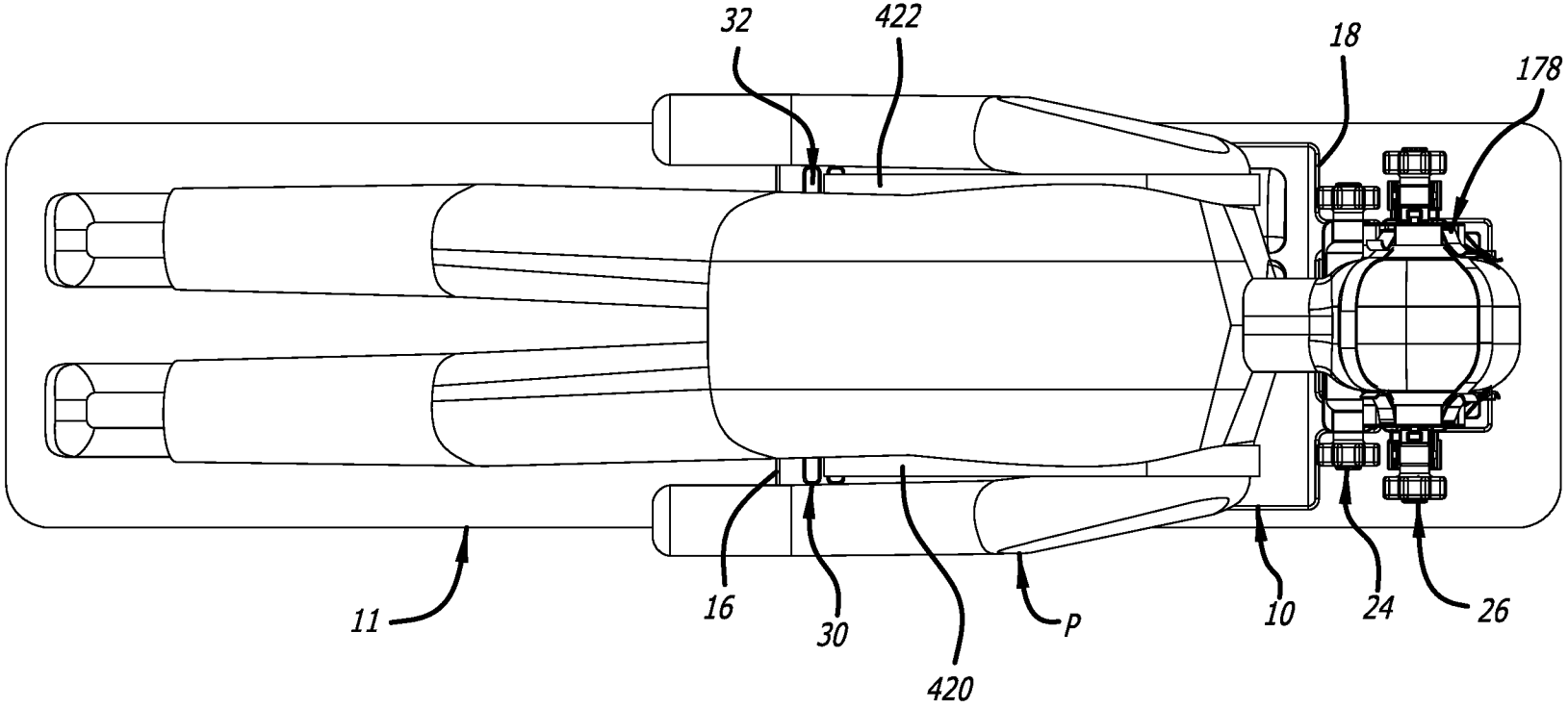
FIG. 3 is a top plan view that illustrates the device and the operating room tabletop of FIG. 1 showing the patient supported thereon.

During use of the device 10, the torso of the patient can be positioned on the panel portion 14 and the posterior support padding 28. As discussed above, the panel portion 14 and/or the docking portion 15 can be integrated into the operating room table 11. Whether using a non-integrated or an integrated panel portion 14, the patient is positioned on the posterior support padding 28. As discussed above, the posterior support padding 28 includes the buttocks support pad 40, the first shoulder support pad 42, the second shoulder support pad 44, and the dorsal support pad 46. The positions of the various pads of the posterior support padding 28 can be adjusted to accommodate differently-sized patients. During or after the pad adjustment process, the torso of the patient can be secured to the panel portion 14 using straps (not shown) attached to the panel portion 14 using the first and second sets of apertures 30 and 32. To illustrate, one end of one of the straps can be inserted into one of the apertures of one of the sets of apertures 30 and looped around the panel portion 14, and the other end of the one of the straps can be inserted into one of the apertures of one of the sets of apertures 32. The straps can be tightened against the patient, and the ends of the straps can be secured in position using interfacing pieces of Velcro®. Additionally, as depicted in FIGS. 2 and 3, a strap 420 can extend from one set of apertures 30 to another set of apertures 30 around the left shoulder of the patient P, and, as depicted in FIG. 3, a strap 422 can extend from one set of apertures 32 to another set of apertures 32 around the right shoulder of the patient P. The straps 420 and 422 can be used to pull the patient's shoulders toward the upper surface 27A.

The neck of the patient can be positioned on the neck support portion 24. Furthermore, the neck support portion 24 itself and portions thereof can be adjusted before or after placement of the patient on the device 10 to accommodate differently-sized patients. As discussed above, the neck support portion 24 is movable in the directions of the first end 16 and the second end 18 relative to the first portion 50 and the second portion 52 of the docking portion 15. Using the first catch-release assembly 82 and the second catch-release assembly 84, the user can adjust and select the position of the neck support portion 24 (and hence, the neck pad 130) relative to the first portion 50 and the second portion 52 of the docking portion 15, and then fix the neck support portion 24 into the selected position. As discussed above, the rotational position of the neck pad 130 also can be adjusted. Because the neck pad 130 rotates in an eccentric manner, the neck pad 130 via rotation thereof moves upwardly and downwardly and moves toward and away from the first end 16 and the second end 18. Using the first rotational adjustment assembly 140 and the second rotational adjustment assembly 142, the user can adjust and select the rotational position of the neck pad 130 relative to the first arm portion 76 and the second arm portion 78, and then fix the neck pad 130 into the selected position. As such, the neck pad 130 via adjustment of the neck support portion 24 relative to the docking collar 15, and via adjustment of the rotational position thereof can be adjusted to accommodate differently-sized patients.

The head of the patient can be positioned on the head support portion 26. Furthermore, the portions of the head support portion 26 can be adjusted before or after the placement of the patient on the device 10 to accommodate differently-sized patients. As discussed above, the second base portion 172 is movable relative to the first base portion 170 in the directions of the first end 16 and the second end 18. Using the third catch-release assembly 238 and the fourth catch-release assembly 240, the user can adjust and select the position of the second base portion 172 (and hence, the first arm portion 174 and the second arm portion 176) relative to the first base portion 170, and then fix the second base portion 172 into the selected position.

The first arm portion 174 and the second arm portion 176 also are movable inwardly and outwardly with respect to the second base portion 172, and using the first lever lock 270 and the second lever lock 272, the user can adjust and select the position of the first arm portion 174 and the second arm portion 176 relative to the second base portion 172, and then fix the first arm portion 174 and the second arm portion 176 into the selected position. And the third portions 290 also are movable inwardly and outwardly with respect to the second portions 248, and hence, the heights of the first arm portion 174 and the second arm portion 176 are adjustable, and using the first adjustment mechanism 300 and the second adjustment mechanism 302, the user can adjust and select positions of the end portions 360 of the third portions 290 relative to the second portion 248, and then fix the third portions 290 into the selected height. As such, the first arm portion 174 and the second arm portion 176 can be adjusted to position the first attachment assembly 362 and the second attachment assembly 364 provided on the end portions 360, respectively. The positioning of the first attachment assembly 362 and the second attachment assembly 364 positions the collar portions 370 thereof to accommodate differently-sized patients to facilitate attachment of the head harness 178 thereto.

Furthermore, the collar portions 370 of the first attachment assembly 362 and the second attachment assembly 364 are rotatable using the handle/hub portions 372. As discussed above, the head harness 178 is attached to the collar portions 370 via receipt of the keys 382 in the keyways 380 of the head harness 178. As such, when the head harness 178 holding the head of the patient therein is attached to the first attachment assembly 362 and the second attachment assembly 364, the head harness 178 (and hence, the patient's head) can be rotated by the user via rotation of the handle/hub portions 372. Thus, the various componentry of the device 10 can be adjusted to accommodate differently-sized patients thereon.

It should be understood that various aspects disclosed herein may be combined in different combinations than the combinations specifically presented in the description and the accompanying drawings. It should also be understood that, depending on the example, certain acts or events of any of the processes of methods described herein may be performed in a different sequence, may be added, merged, or left out altogether (e.g., all described acts or events may not be necessary to carry out the techniques). In addition, while certain aspect of this disclosure are described as being performed by a single module or unit for purposes of clarity, it should be understood that the techniques of this disclosure may be performed by a combination of units or modules associated with, for example, a medical device.

What is claimed is:

1. A method for adjustably supporting a patient in a supine position for surgery, the method comprising:

providing a patient support structure having a back support portion, a neck support portion, and a head support portion, the neck support portion and the head support portion each being attached to the back support portion, the back support portion including a panel portion having a first end, an opposite second end, and an upper surface extending between the first end and the second end, and the back support portion including padding movably attached to relative to the upper surface, the neck support portion including at least one upwardly-extending support arm, a rotatable neck pad, and at least one rotational adjustment assembly, the at least one upwardly-extending support arm being attached to the back support portion, the at least one upwardly-extending support arm supporting at least portions of the rotatable neck pad and the at least one rotational adjustment assembly thereon, the rotatable neck pad including a central axis, the at least one rotational adjustment assembly being interconnected with the neck pad, and the at least one rotational adjustment assembly being configured to eccentrically rotate the neck support pad about an axis offset from the central axis of the rotatable neck pad;

the head support portion including at least one base portion, an upwardly-extending first arm portion, an upwardly-extending second arm portion, a first attachment assembly, a second attachment assembly, and a head harness, the upwardly-extending first arm portion and the upwardly-extending second arm portion being movably attached to the at least one base portion, each of the upwardly-extending first arm portion and the upwardly-extending second arm portion being movable between an inward first position and an outward second position relative to the at least one base portion, a first end portion of the upwardly-extending first arm portion supporting the first attachment assembly, and a second end portion of the upwardly-extending second arm portion supporting the second attachment assembly, the head harness being rotatably supportable by the first attachment assembly and the second attachment assembly between the upwardly-extending first arm portion and the upwardly-extending second arm portion, contacting at least a portion of the back of the patient to the padding of the back support portion;

contacting at least a portion of the neck of the patient to the rotatable neck pad of the neck support portion;

holding a portion of the head of the patient in the head harness of the head support portion, and supporting the head harness and the head of the patient between the upwardly-extending first arm portion and the upwardly-extending second arm portion;

adjusting the padding of the back support portion to facilitate positioning of the back of the patient;

eccentrically rotating the neck support pad using the at least one rotational adjustment assembly to facilitate positioning of the neck of the patient; and rotating the head harness using the first attachment assembly and the second attachment assembly to facilitate positioning the head of the patient.

2. The method of claim 1, wherein the at least one rotational adjustment assembly of the neck support portion includes a first rotational adjustment assembly and a second rotational adjustment assembly, and the at least one upwardly-extending support arm of the neck support portion includes a first support arm portion and a second support arm portion, an end portion of the first support arm portion supporting the first rotational adjustment assembly and a first end of the neck support pad, an end portion of the second support arm portion supporting the second rotational adjustment assembly and a second end of the neck support pad, the first end of the neck support pad being interconnected with the first rotational adjustment assembly, and the second end of the neck support pad being interconnected with the second rotational adjustment assembly.

3. The method of claim 2, wherein first support arm portion and the second arm portion of the neck support portion are each movably attached to a portion of the back support portion, and are each capable of movement between a first position and a second position in the direction of the first end and the second end of the panel portion, and the neck support portion includes a first catch-release assembly and a second catch-release assembly, the first catch-release assembly affording selective positioning of the first support arm portion relative to the back support portion, and the second catch-release assembly affording selective positioning of the second support arm portion relative to the back support portion.

4. The method of claim 3, further comprising selectively positioning the first arm portion and the second arm portion relative to the back support portion using the first catch-release assembly and the second catch-release assembly, respectively, to position the neck support pad relative to the patient.

5. The method of claim 1, wherein the at least one base portion includes a first base portion, a second base portion, a first catch-release assembly, and a second catch-release assembly, the first base portion being removably attached to the back support portion, the second base portion supporting the upwardly extending first arm portion and the upwardly-extending second arm portion, the second base portion being movably attached relative the first base portion, and the second base portion being movable between a first position and a second position in the direction of the first end and the second end, the first catch-release assembly and the second catch-release assembly affording selective positioning of the second base portion relative to the first base portion.

6. The method of claim 5, further comprising selective positioning the second base portion relative to the first base portion and the back support portion using the first catch-release assembly and the second catch-release assembly to afford positioning of the head harness and the head of the patient.

7. The method of claim 1, wherein the upwardly-extending first arm portion and the upwardly-extending second arm portion are capable of telescoping movement to move each of the end portions thereof between a lower first position and an upper second position.

8. The method of claim 7, further comprising moving each of the end portions of the upwardly-extending first arm portion and the upwardly-extending second arm portion to afford positioning of the harness portion and the head of the patient.

9. A method for adjustably supporting a patient in a supine position for surgery, the method comprising:

providing a patient support structure having a back support portion, a neck support portion, and a head support portion, the neck support portion and the head support portion each being attached to the back support portion, contacting at least a portion of the back of the patient to padding of the back support portion, the back support portion including the padding, a first end, an opposite second end, and an upper surface for supporting the padding;

contacting at least a portion of the neck of the patient to a neck pad of the neck support portion, the neck support portion including the neck pad, and at least one upwardly-extending support arm, the at least one upwardly-extending support arm supporting at least portions of the neck pad, and the at least one upwardly-extending support arm being movably attached to a portion of the back support portion, the at least one upwardly-extending support arm being capable of movement between a first position and a second position in the direction of the first end and the second end of the back support portion;

holding a portion of the head of the patient in a head harness of the head support portion, and supporting the head harness and the head of the patient between an upwardly-extending first arm portion and an upwardly-extending second arm portion of the head support portion, the head support portion including the head harness, the upwardly-extending first arm portion, the upwardly-extending second arm portion, at least one base portion, a first attachment assembly, and a second attachment assembly, the upwardly-extending first arm portion including a first end portion supporting the first attachment assembly, and the upwardly-extending second arm portion including a second end portion supporting the second attachment assembly;

adjusting the padding of the back support portion to facilitate positioning of the back of the patient;

adjusting the position of neck support pad to facilitate positioning of the neck of the patient; and rotating the head harness using the first attachment assembly and the second attachment assembly to facilitate positioning the head of the patient.

10. The method of claim 9, wherein the neck support portion includes a first rotational adjustment assembly and a second rotational adjustment assembly, and the at least one upwardly-extending support arm of the neck support portion includes a first support arm portion and a second support arm portion, an end portion of the first support arm portion supporting the first rotational adjustment assembly and a first end of the neck support pad, an end portion of the second support arm portion supporting the second rotational adjustment assembly and a second end of the neck support pad, the first end of the neck support pad being interconnected with the first rotational adjustment assembly, and the second end of the neck support pad being interconnected with the second rotational adjustment assembly.

11. The method of claim 10, wherein the neck pad includes a central axis, and the first rotational adjustment assembly and the second rotational adjustment assembly being configured to eccentrically rotate the neck support pad about an axis offset from the central axis of the rotatable neck pad; and further comprising eccentrically rotating the neck support pad using the first rotational adjustment assembly and the second rotational adjustment assembly to facilitate positioning of the neck of the patient.

12. The method of claim 10, wherein first support arm portion and the second arm portion of the neck support portion are each movably attached to a portion of the back support portion, and are each capable of movement between a first position and a second position in the direction of the first end and the second end of the panel portion, and the neck support portion includes a first catch-release assembly and a second catch-release assembly, the first catch-release assembly affording selective positioning of the first support arm portion relative to the back support portion, and the second catch-release assembly affording selective positioning of the second support arm portion relative to the back support portion.

13. The method of claim 12, further comprising selectively positioning the first arm portion and the second arm portion relative to the back support portion using the first catch-release assembly and the second catch-release assembly, respectively, to position the neck support pad relative to the patient.

14. The method of claim 9, wherein the at least one base portion includes a first base portion, a second base portion, a first catch-release assembly, and a second catch-release assembly, the first base portion being removably attached to the back support portion, the second base portion supporting the upwardly extending first arm portion and the upwardly-extending second arm portion, the second base portion being movably attached relative the first base portion, and the second base portion being movable between a first position and a second position in the direction of the first end and the second end, the first catch-release assembly and the second catch-release assembly affording selective positioning of the second base portion relative to the first base portion.

15. The method of claim 14, further comprising selective positioning the second base portion relative to the first base portion and the back support portion using the first catch-release assembly and the second catch-release assembly to afford positioning of the head harness and the head of the patient.

16. The method of claim 9, wherein the upwardly-extending first arm portion and the upwardly-extending second arm portion of the head support portion are capable of telescoping movement to move each of the end portions thereof between a lower first position and an upper second position.

17. The method of claim 16, further comprising moving each of the end portions of the upwardly-extending first arm portion and the upwardly-extending second arm portion to afford positioning of the head harness and the head of the patient.

18. A patient support structure for supporting a patient in a supine position for surgery, the patient support structure comprising:

a back support portion including a panel portion having a first end, an opposite second end, and an upper surface extending between the first end and the second end, and the back support portion including padding movably attached to relative to the upper surface;

a neck support portion including an upwardly-extending first support arm, an upwardly-extending second support arm, a neck support pad, a first rotational adjustment assembly, and a second rotational adjustment assembly, the upwardly-extending first support arm and the upwardly-extending second support arm being movably attached to the back support portion, the upwardly-extending first support arm and the upwardly-extending second support arm each supporting at least portions of the rotatable neck pad, an end portion of the first support arm portion supporting the first rotational adjustment assembly and a first end of the neck support pad, an end portion of the second support arm portion supporting the second rotational adjustment assembly and a second end of the neck support pad, the first end of the neck support pad being interconnected with the first rotational adjustment assembly, and the second end of the neck support pad being interconnected with the second rotational adjustment assembly, the rotatable neck pad including a central axis, the first rotational adjustment assembly and the second rotational adjustment assembly being configured to eccentrically rotate the neck support pad about an axis offset from the central axis of the rotatable neck pad; and a head support portion including at least one base portion, an upwardly-extending first arm portion, an upwardly-extending second arm portion, a first attachment assembly, a second attachment assembly, and a head harness, the upwardly-extending first arm portion and the upwardly-extending second arm portion being movably attached to the at least one base portion, each of the upwardly-extending first arm portion and the upwardly-extending second arm portion being movable between an inward first position and an outward second position relative to the at least one base portion, a first end portion of the upwardly-extending first arm portion supporting the first attachment assembly, and a second end portion of the upwardly-extending second arm portion supporting the second attachment assembly, the head harness being rotatably supported by the first attachment assembly and the second attachment assembly between the upwardly-extending first arm portion and the upwardly-extending second arm portion.

19. The patient support structure of claim 18, wherein first support arm portion and the second arm portion of the neck support portion are each movably attached to a portion of the back support portion, and are each capable of movement between a first position and a second position in the direction of the first end and the second end of the panel portion, and the neck support portion includes a first catch-release assembly and a second catch-release assembly, the first catch-release assembly affording selective positioning the first support arm portion relative to the back support portion, and the second catch-release assembly affording selective positioning of the second support arm portion relative to the back support portion.

20. The patient support structure of claim 18, wherein the at least one base portion includes a first base portion, a second base portion, a first catch-release assembly, and a second catch-release assembly, the first base portion being removably attached to the back support portion, the second base portion supporting the upwardly extending first arm portion and the upwardly-extending second arm portion, the second base portion being movably attached relative the first base portion, and the second base portion being movable between a first position and a second position in the direction of the first end and the second end, the first catch-release assembly and the second catch-release assembly affording selective positioning of the second base portion relative to the first base portion.

* * * * *